US007782349B2

(12) United States Patent
Baba et al.

(10) Patent No.: US 7,782,349 B2
(45) Date of Patent: Aug. 24, 2010

(54) THERMAL PRINTER AND METHOD OF CONTROLLING THE SAME

(75) Inventors: Sumio Baba, Izunokuni (JP); Satoshi Yamada, Mishima (JP); Hiroyuki Taguchi, Kawasaki (JP)

(73) Assignees: Toshiba Tec Kabushiki Kaisha, Tokyo (JP); NCR Corporation, Dayton, OH (US)

( * ) Notice: Subject to any disclaimer, the term of this patent is extended or adjusted under 35 U.S.C. 154(b) by 402 days.

(21) Appl. No.: 11/681,922

(22) Filed: Mar. 5, 2007

(65) Prior Publication Data

US 2007/0279476 A1 Dec. 6, 2007

(30) Foreign Application Priority Data

| | | |
|---|---|---|
| May 31, 2006 | (JP) | 2006-151695 |
| May 31, 2006 | (JP) | 2006-152577 |
| Jun. 1, 2006 | (JP) | 2006-153608 |
| Jun. 1, 2006 | (JP) | 2006-153609 |

(51) Int. Cl.
*B41J 2/32* (2006.01)

(52) U.S. Cl. ..... 347/171

(58) Field of Classification Search ..... 347/171, 347/190, 191, 173, 175, 5; 358/1.15, 1.9
See application file for complete search history.

(56) References Cited

U.S. PATENT DOCUMENTS

| | | | | |
|---|---|---|---|---|
| 5,619,623 | A * | 4/1997 | Takayanagi et al. | 358/1.15 |
| 6,118,469 | A | 9/2000 | Hosomi | |
| 6,704,036 | B2 * | 3/2004 | Hayashi et al. | 347/175 |
| 6,759,366 | B2 | 7/2004 | Beckerdite et al. | |
| 6,784,906 | B2 | 8/2004 | Long et al. | |
| 2003/0025779 | A1 | 2/2003 | Miyazaki | |
| 2004/0083917 | A1 | 5/2004 | Kujirai | |

FOREIGN PATENT DOCUMENTS

| | | |
|---|---|---|
| EP | 0 947 340 | 10/1999 |
| EP | 1226952 | 7/2002 |
| EP | 1564014 | 8/2005 |
| EP | 1 862 319 | 12/2007 |
| JP | 58-008668 | 1/1983 |
| JP | 59-068268 | 4/1984 |
| JP | 60-190378 | 9/1985 |
| JP | 61-003765 | 1/1986 |

(Continued)

OTHER PUBLICATIONS

Japanese Office Action dated Mar. 27, 2008 corresponding to U.S. Appl. No. 11/681,922, filed on Mar. 5, 2007.

(Continued)

*Primary Examiner*—K. Feggins
(74) *Attorney, Agent, or Firm*—Turocy & Watson, LLP

(57) ABSTRACT

A thermal paper sheet having heat-sensitive layers on a first surface and a second surface having a front-and-rear relationship is prepared. A first thermal head which comes into contact with a front surface of this thermal paper sheet and a second thermal head which comes into contact with a rear surface 1*b* of the same are provided. Further, printing data input from the outside is divided into first printing data and second printing data. The thermal heads are driven in accordance with the printing data.

35 Claims, 19 Drawing Sheets

FOREIGN PATENT DOCUMENTS

| | | |
|---|---|---|
| JP | 62-63146 | 4/1987 |
| JP | 01-271262 | 10/1989 |
| JP | 03-051149 | 3/1991 |
| JP | 06-024082 | 2/1994 |
| JP | 06-27153 | 4/1994 |
| JP | 06-270482 | 9/1994 |
| JP | 09-233256 | 9/1997 |
| JP | 10-076713 | 3/1998 |
| JP | 11-286147 | 10/1999 |
| JP | 2000-315275 | 11/2000 |
| JP | 2001-199095 | 7/2001 |
| JP | 2002-029078 | 1/2002 |
| JP | 2002-109527 | 4/2002 |
| JP | 2002-234215 | 8/2002 |
| JP | 2003-058950 | 2/2003 |
| JP | 2003-200641 | 7/2003 |
| JP | 2004-013630 | 1/2004 |
| JP | 2004-168379 | 6/2004 |
| JP | 2005-329572 | 12/2005 |
| JP | 2005-329684 | 12/2005 |

OTHER PUBLICATIONS

Japanese Office Action dated Apr. 4, 2008 corresponding to U.S. Appl. No. 11/681,922, filed on Mar. 5, 2007.

Japanese Office Action dated Apr. 17, 2008 corresponding to U.S. Appl. No. 11/681,922, filed on Mar. 5, 2007.

Japanese Office Action dated Aug. 8, 2008 corresponding to U.S. Appl. No. 11/681,922, filed on Mar. 5, 2007.

Japanese Office Action dated Aug. 6, 2008 corresponding to U.S. Appl. No. 11/681,922, filed on Mar. 5, 2007.

Japanese Office Action mailed on Jan. 20, 2009, corresponding to U.S. Appl. No. 11/681,922, filed on Mar. 5, 2007.

Chinese Office Action mailed on Jan. 9, 2009 corresponding to U.S. Appl. No. 11/681,922, filed on Mar. 5, 2007.

European Search Report for 07 10 9057 mailed on Mar. 1, 2010.

* cited by examiner

THERMAL PRINTER AND METHOD OF CONTROLLING THE SAME

CROSS-REFERENCE TO RELATED APPLICATIONS

This application is based upon and claims the benefit of priority from prior Japanese Patent Applications No. 2006-151695, filed May 31, 2006; No. 2006-152577, filed May 31, 2006; No. 2006-153608, filed Jun. 1, 2006; and No. 2006-153609, filed Jun. 1, 2006, the entire contents of all of which are incorporated herein by reference.

BACKGROUND OF THE INVENTION

1. Field of the Invention

The present invention relates to a thermal printer that uses a thermal paper sheet having heat-sensitive layers on both surfaces thereof, and a method of controlling the same.

2. Description of the Related Art

A thermal paper sheet used in a thermal printer has a heat-sensitive layer on one surface thereof. In accordance with this structure, a thermal printer has one thermal head, and prints printing data input from the outside on one surface of a thermal paper sheet by using the single thermal head. The printed thermal paper sheet is cut by a cutter and provided to a user.

When an amount of printing data input from the outside is large, a thermal paper sheet on which the data is to be printed becomes long and hence it is difficult to handle by a user.

On the other hand, a thermal paper sheet having heat-sensitive layers on both surfaces thereof has been recently developed. When this thermal paper sheet is used and printing data is divided and printed on both surfaces of the thermal paper sheet, the length of the thermal paper sheet provided to a user can be reduced, which saves thermal paper.

In order to print data on both surfaces of the thermal paper sheet, there is required processing of, e.g., feeding a paper sheet to an image forming portion of a photosensitive drum or a development unit to form an image on a surface of the paper sheet, returning the paper sheet having the image formed thereon to the image forming portion while reversing the paper sheet, and forming an image of a rear surface of the paper sheet by the image forming portion, like double-side copying in a copying machine (see, e.g., Jpn. Pat. Appln. KOKAI Publication No. 233256-1997 and Jpn. Pat. Appln. KOKAI Publication No. 24082-1994).

However, processing similar to that used in a copying machine takes too much time, and therefore cannot be applied to a thermal printer used for issuing a sales receipt to a customer at, e.g., a store.

BRIEF SUMMARY OF THE INVENTION

It is an object of the present invention to provide a highly practical thermal printer that can rapidly print printing data input from the outside on both surfaces of a thermal paper sheet.

According to the present invention, there is provided a thermal printer, comprising:

a thermal paper sheet which has heat-sensitive layers on a first surface and a second surface having a front-and-rear relationship, and is subjected to paper feed;

a first thermal head which prints on the first surface of the thermal paper sheet;

a second thermal head which prints on the second surface of the thermal paper sheet; and a first control section which divides printing data input from the outside into first printing data for the first thermal head and second printing data for the second thermal head.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

[1] First Embodiment

Figure 1:
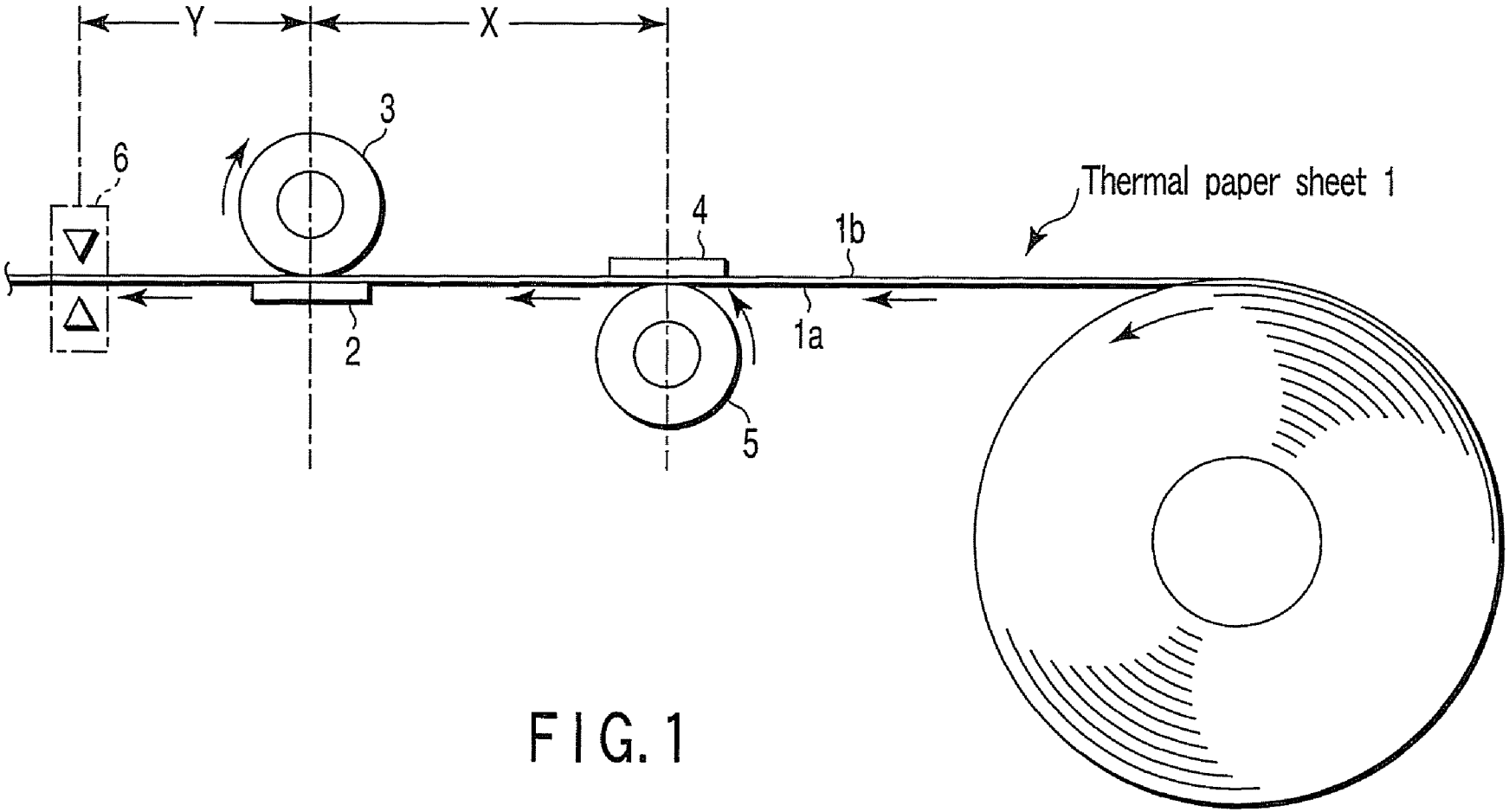
FIG. 1 is a view showing a structure of a primary part in each embodiment.

A first embodiment according to the present invention will now be described hereinafter with reference to the accompanying drawings. First, FIG. 1 shows a structure of a primary part.

Reference numeral 1 denotes a thermal paper sheet. The thermal paper sheet 1 has heat-sensitive layers on both surfaces thereof, i.e., a first surface (which will be referred to as a front surface) 1*a* and a second surface (which will be referred to as a rear surface) 1*b* having a front-and-rear relationship, respectively. A proximal end side of the thermal paper sheet 1 is rolled up in such a manner that the front surface 1*a* becomes an inner side, and a distal end side is fed in a direction indicated by an arrow in the drawing by a later-described paper feed mechanism 22. The heat-sensitive layer is made up of a material that is colored into, e.g., black or red when heated to a predetermined temperature or above.

A first thermal head 2 that comes into contact with the front surface 1*a* of the thermal paper sheet 1 and a second thermal head 4 that comes into contact with the rear surface 1*b* are provided along a paper feed direction of this thermal paper sheet 1. Each of the first and the second thermal heads 2 and 4 has a shape extending in a direction perpendicular to the paper feed direction of the thermal paper sheet 1, and has many heating elements arranged in a direction perpendicular to the paper feed direction. The first and the second thermal heads 2 and 4 are arranged at positions separated from each other along the paper feed direction of the thermal paper sheet 1. The first thermal head 2 is present on a downstream side of the second thermal head 4 in a paper feed direction. Further, a first platen roller 3 is arranged at a position facing the first thermal head 2, with the thermal paper sheet 1 interposed therebetween, and a second platen roller 5 is arranged at a position facing the second thermal head 4, with the thermal paper sheet 1 interposed therebetween. Furthermore, a cutter 6 that cuts the thermal paper sheet 1 on a rear side of a printing position is arranged on a downstream side of the first thermal head 2 in the paper feed direction.

A distance between the second thermal head 4 on the upstream side and the first thermal head 2 on the downstream side is X, and a distance between the first thermal head 2 and the cutter 6 is Y.

Figure 2:
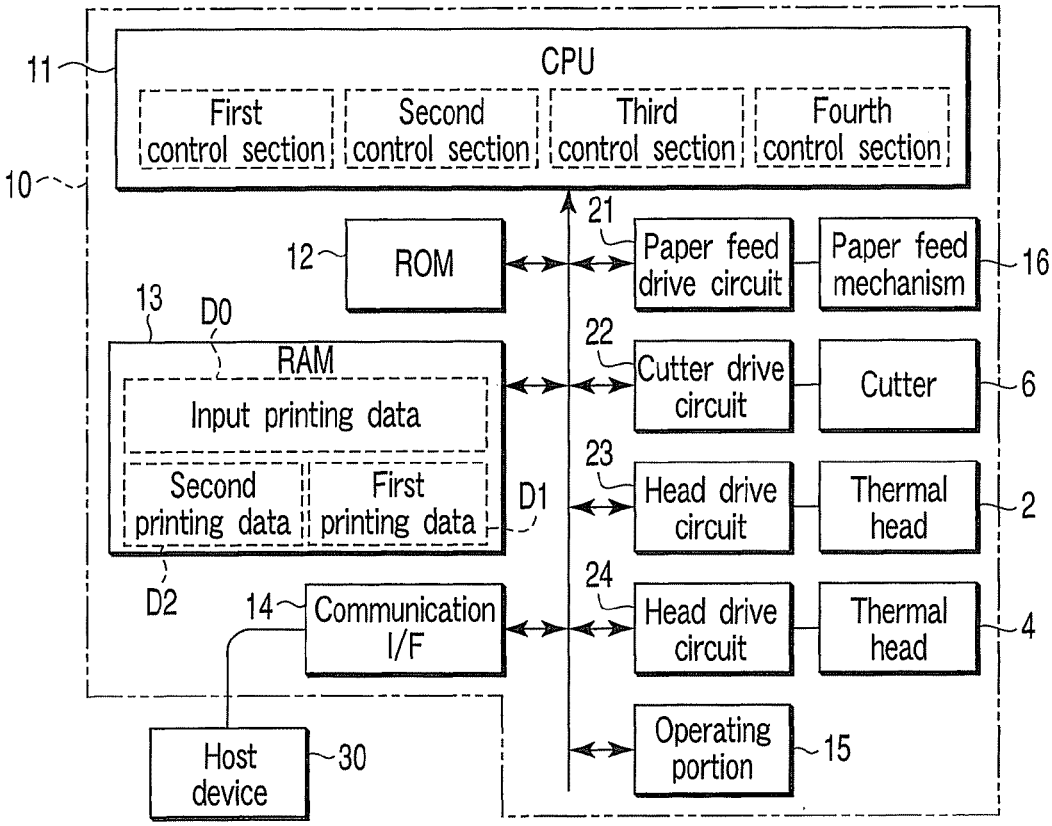
FIG. 2 is a block diagram showing a control circuit in a first embodiment.

FIG. 2 shows a control circuit of a thermal printer main body 10 including the structure depicted in FIG. 1.

To a CPU 11 are connected an ROM 12 that stores a control program, an RAM 13 as a storage section that stores data, a communication interface 14 that performs data transmission/reception with a host device 30, an operating portion 15 that is used to set operating conditions, a paper feed drive circuit 21 that drives a paper feed mechanism 16 for the thermal paper sheet 1, a cutter drive circuit 22 that drives the cutter 6, a first head drive circuit 23 that drives the first thermal head 2, a second head drive circuit 24 that drives the second thermal head 4, and others. The paper feed mechanism 16 for the thermal paper sheet 1 is constituted of the platen rollers 3 and 5 and a motor that drives the platen rollers 3 and 5 to rotate. The first drive circuit 23 drives the first thermal head 2 in accordance with later-described first printing data D1. The second head drive circuit 24 drives the second thermal head 4 in accordance with later-described printing data D2.

The CPU 11 has the following means (1) to (4) as primary functions.

(1) A first control section that divides printing data D0 input from the external host device 30 into first printing data D1 for the first thermal head 2, and second printing data D2 for the second thermal head 4. The printing data D0, the first printing data D1, and the second printing data D2 are all stored in the RAM 13.

(2) A second control section that first starts driving of the second thermal head 2 in accordance with the second printing data D2 while feeding the thermal paper sheet 1, and starts driving of the first thermal head 2 in accordance with the first printing data D1 when a printing start position based on the first driving corresponds to the first thermal head 2.

(3) A third control section that first starts driving of the first thermal head 2 in accordance with the first printing data D1 while feeding the thermal paper sheet 1, temporarily reverses a paper feed direction of the thermal paper sheet 1 after end of the first driving, and restores the paper feed direction of the thermal paper sheet 1 to the normal direction to start driving of the second thermal head 4 in accordance with the second printing data D0 when a printing start position based on driving of the first thermal head 2 returns to a position corresponding to the second thermal head 4.

(4) A fourth control section that simultaneously starts driving of the first thermal head 2 in accordance with the first printing data D1 and driving of the second thermal head 4 in accordance with the second printing data D2 while feeding the thermal paper sheet 1. It is to be noted that the first control section divides the printing data D0 into the first printing data D1 and the second printing data D2 based on an amount of the printing data, which allows printing end positions of the thermal heads 2 and 4 to be equal to each other when this fourth control section simultaneously starts driving of the thermal heads 2 and 4.

Figure 3:
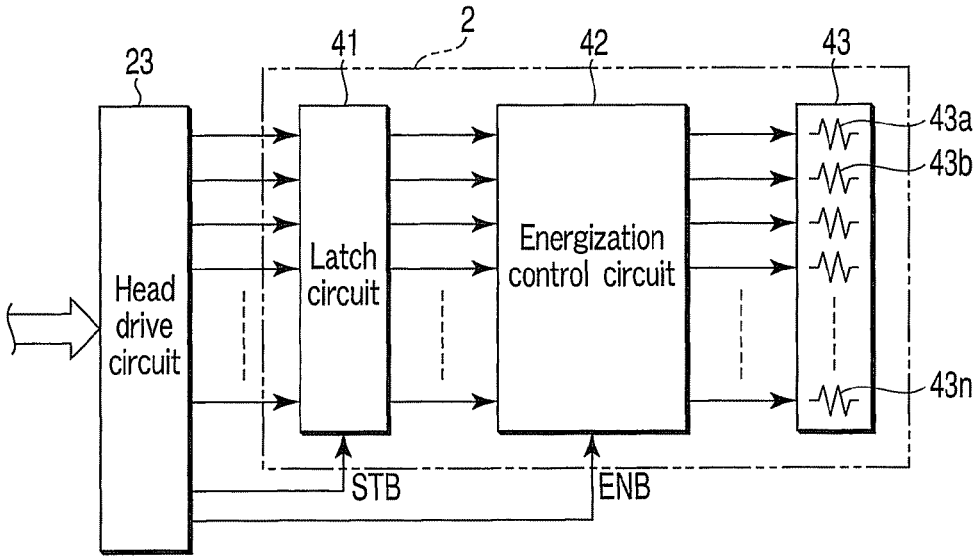
FIG. 3 is a block diagram showing a specific structure of a thermal head in each embodiment.

It is to be noted that the first thermal head 2 is constituted of a latch circuit 41, an energization control circuit 42, and an edge head 43 as shown in FIG. 3. The edge head 43 has many thermal-transfer heating elements 43*a*, 43*b*, . . . 43*n* that are linearly arranged. The latch circuit 41 latches the first printing data D1 supplied from the head drive circuit 23 for each line in accordance with a strobe signal STB from the head drive circuit 23. The energization control circuit 42 control energizes the heating elements 43*a*, 43*b*, . . . 43*n* of the edge head 43 in accordance with data in the latch circuit 41 at a timing where an enable signal ENB fed from the head drive circuit 23 becomes active. The structure of the second thermal head 4 is the same as that of the first thermal head 2. Therefore, its explanation will be omitted.

A function will now be explained.

(a) First Operation Mode

A function performed when a first operation mode is set by the operating portion 15 will now be explained.

When the printing data D0 is input to the thermal printer from the external host device 30, the printing data D0 is stored in the RAM 13. In accordance with this storage, the printing data D0 is divided into the first printing data D1 and the second printing data D2. An amount or conditions of the division are set based on an operation of the operating portion 15 or an instruction from the host device 30. There is "50% to 50%" as an amount of the division, and there is a data type as conditions of the division, for example. As data types, in the case of a sales receipt at a store, there are a money character, an information text for customers, an advertising text, an illustration, and others, for example.

Figure 4:
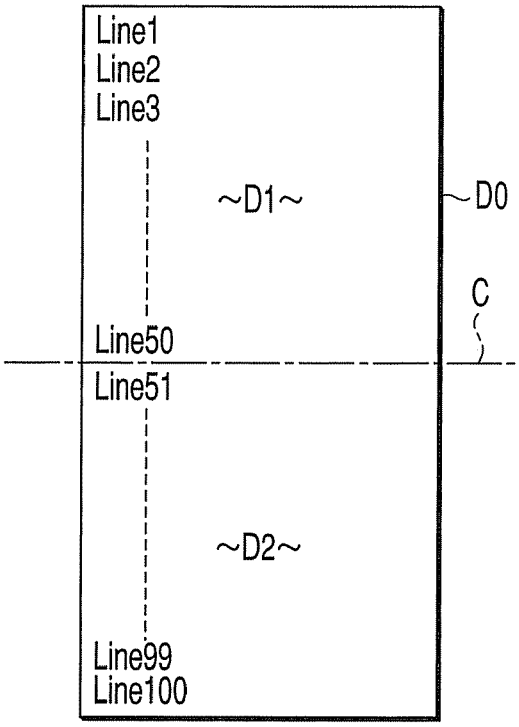
FIG. 4 is a view showing a format of printing data D0 in the first embodiment.

FIG. 4 shows an example where the printing data D0 is divided into the first printing data D1 and the second printing data D2.

That is, the printing data D0 constituted of printing data from a first row to a 100th row is divided into the first printing data D1, formed of printing data from the first row to a 50th row, and the second printing data D2, formed of printing data from a 51st row to the 100th row, with a boundary position C at the center being determined as a boundary. The divided first printing data D1 and second printing data D2 are stored in the RAM 13.

After this division, feeding of the thermal paper sheet 1 is started, and driving of the second thermal head 4 in accordance with the second printing data D2 is first commenced, thereby printing the printing data from the 51st row to the 100th row on the rear surface 1*b* of the thermal paper sheet 1. When feeding of the thermal paper sheet 1 advances and a printing start position on the rear surface 1*b* side based on driving of the second thermal head 4 enters a state corresponding to the first thermal head 2, driving of the first thermal head 2 in accordance with the first printing data D1 is started, thereby printing the printing data from the first row to the 50th row on the front surface 1*a* of the thermal paper sheet 1.

Figure 5:
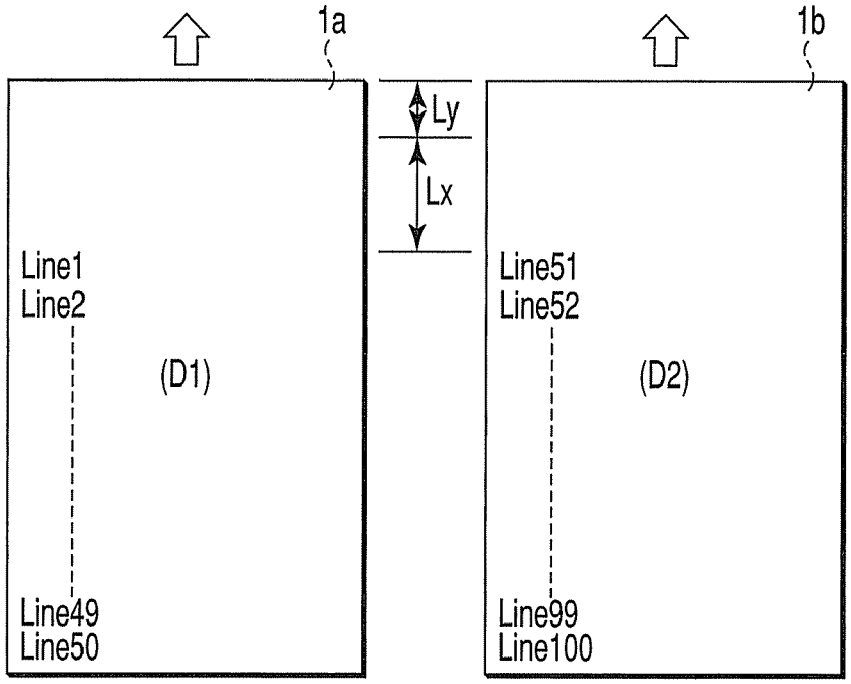
FIG. 5 is a view showing a printing result in a first operation mode in the first embodiment.

As shown in FIG. 5, the printing data from the 51st row to the 100th row as the second printing data D2 is printed on the rear surface 1*b* of the thermal paper sheet 1 and the printing data from the first row to the 50th row as the first printing data D1 is printed on the front surface 1*a* of the thermal paper sheet 1 in this manner. A blank region Ly corresponding to the distance Y from the cutter 6 to the first thermal head 2 is produced and a blank region Lx corresponding to the distance X from the first thermal head 2 to the second thermal head 4 is generated on a distal end side of each of the rear surface 1*b* and the front surface 1*a*.

The printed thermal paper sheet 1 is cut by the cutter 6 to be provided to a user.

Figure 6:
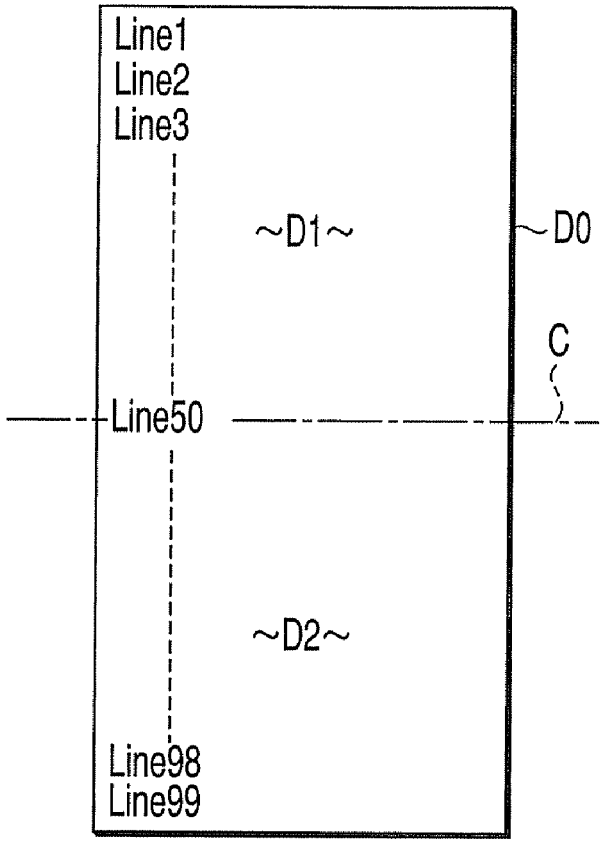
FIG. 6 is a view showing an example where printing data is present at a boundary position for division of the printing data D0 in the first embodiment.

It is to be noted that, when dividing the printing data D0 into the first printing data D1 and the second printing data D2, printing data of the 50th row may be present at the boundary position C at the center of the printing data D0 as shown in FIG. 6. In this case, the printing data at the boundary position C is incorporated into one of the first printing data D1 and the second printing data D2 in accordance with conditions preset by the operating portion 15 or conditions instructed from the host device 30.

Figure 7:
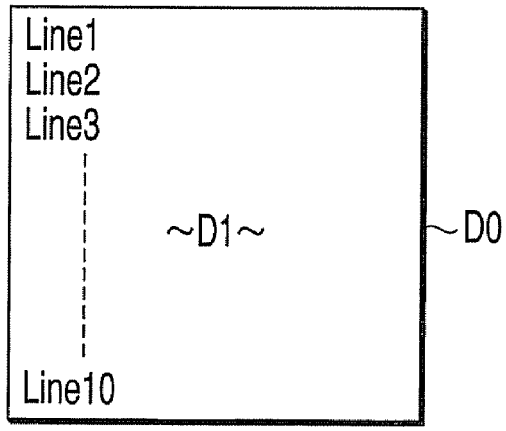
FIG. 7 is a view showing a format of a small amount of the printing data D0 in the first embodiment.

Moreover, as shown in FIG. 7, when an amount of the printing data D0 is less than a predetermined amount, executing double-side printing based on division of data has the opposite effect of producing a sales receipt that is difficult to handle. Based on this determination, all of the printing data D0 is set as one of the first printing data D1 and the second printing data D2 in accordance with conditions preset by the operating portion 15 or conditions instructed from the host device 30.

In the example depicted in FIG. 7, all of the printing data D0 is set as the first printing data D1. In this case, the first printing data D1 is printed on the front surface 1*b* of the thermal paper sheet 1. Nothing is printed on the rear surface 1*b* of the thermal paper sheet 1.

(b) Second Operation Mode

An operation when a second operation mode is set by the operating portion 15 will now be explained.

Processing from the beginning to division of the printing data D0 into the first printing data D1 and the second printing data D2 is the same as that in the first operation mode.

After division, feeding of the thermal paper sheet 1 is started, and driving of the first thermal head 2 in accordance with the first printing data D1 is commenced, thereby printing the printing data from the first row to the 50th row on the front surface 1*a* of the thermal paper sheet 1. After end of printing on the front surface 1*a* side based on driving of the first thermal head 2, feeding of the thermal paper sheet 1 is temporarily reversed, and feeding of the thermal paper sheet 1 returns to the normal state when a printing start position on the front surface 1*a* side based on driving of the first thermal head 2 returns to a position corresponding to the second thermal head 4. In this state, driving of the second thermal head 4 in accordance with the second printing data D2 is started, whereby the printing data from the 51st row to the 100th row is printed on the rear surface 1*b* of the thermal paper sheet 1.

Figure 8:
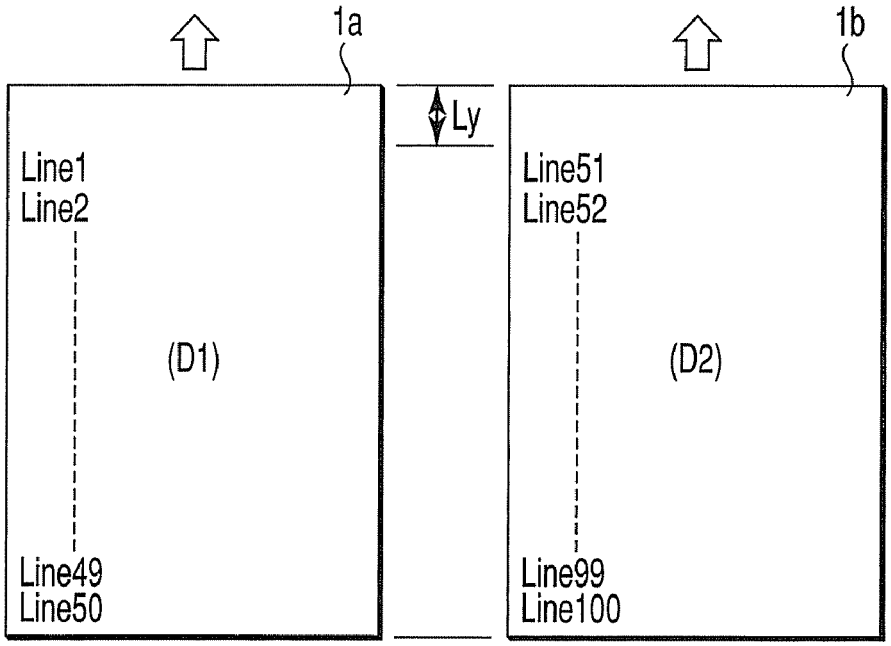
FIG. 8 is a view showing a printing result in a second operation mode in the first embodiment.

In this manner, as shown in FIG. 8, the printing data from the first row to the 50th row as the first printing data D1 is printed on the front surface 1*a* of the thermal paper sheet 1, and the printing data from the 51st row to the 100th row as the second printing data D2 is printed on the rear surface 1*b* of the thermal paper sheet 1. The blank region Ly corresponding to the distance Y from the cutter 6 to the first thermal head 2 is generated on the distal end side of each of the front surface 1*a* and the rear surface 1*b*.

The printed thermal paper sheet 1 is cut by the cutter 6 to be provided to a user.

When printing data is present at the boundary position C at the center of the printing data D0, the printing data at the boundary position C is incorporated into one of the first printing data D1 and the second printing data D2 like the first operation mode.

When an amount of the printing data D0 is less than a predetermined amount, all of the printing data D0 is set as one of the first printing data D1 and the second printing data D2, as in the first operation mode.

(c) Third Operation Mode

A function when a third operation mode is set by the operating portion 15 will now be explained.

Processing of dividing the printing data D0 is slightly different from those in the first operation mode and the second operation mode.

That is, assuming that driving of the first thermal head 2 in accordance with the first printing data D1 and driving of the second thermal head 4 in accordance with the second printing data D2 are simultaneously started, the printing data D0 is divided into the first printing data D1 and the second printing data D2 based on an amount of the printing data, which allows printing end positions of both the thermal heads 2 and 4 to become equal to each other at the time of simultaneous driving.

After division, feeding of the thermal paper sheet 1 is started, and driving of the first thermal head 2 in accordance with the first printing data D1 and driving of the second thermal head 4 in accordance with the second printing data D2 are simultaneously commenced.

Figure 9:
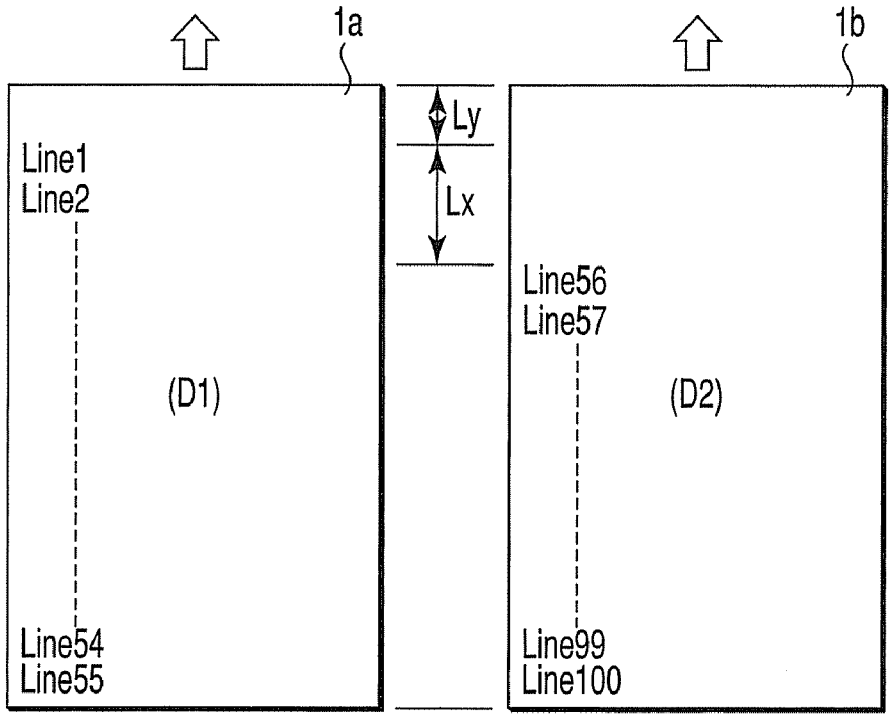
FIG. 9 is a view showing a printing result in a third operation mode in the first embodiment.

In this manner, as shown in FIG. 9, in a state where the blank region Ly corresponding to at least the distance Y from the cutter 6 to the first thermal head 2 is assured on the distal end side, the printing data from the first row to, e.g., the 55th row as the first printing data D1 is printed on the front surface 1*a* of the thermal paper sheet 1. The blank region Ly is determined by the operating portion 15 or the host device 30 in advance. In a state where the blank region Ly is assured and the blank region Lx corresponding to the distance X from the first thermal head 2 to the second thermal head 4 is assured on the distal end side, the printing data from the 56th row to the 100th row as the second printing data D2 is printed on the rear surface 1*b* of the thermal paper sheet 1.

As a result, a lowermost printing position on the front surface 1*a* exactly matches with a lowermost printing position on the rear surface 1*b*.

The printed thermal paper sheet 1 is cut by the cutter 6 to be provided to a user.

When printing data is present at the boundary position for division of the printing data D0, the printing data at the boundary position is incorporated into one of the first printing data D1 and the second printing data D2, as in the first operation mode.

When an amount of the printing data D0 is less than a predetermined amount, all of the printing data D0 is set as one of the first printing data D1 and the second printing data D2, as in the first operation mode.

(d) Fourth Operation Mode

A function when a fourth operation mode is set by the operating portion 15 will now be explained.

The processing of, dividing the printing data D0 is different from those in the respective operation modes.

That is, the printing data D0 is alternately divided into the first printing data D1 and the second printing data D2 in accordance with a predetermined amount, e.g., printing data corresponding to two rows.

After division, feeding of the thermal paper sheet 1 is started, and driving of the second thermal head 4 in accordance with the second printing data D2 is commenced. When feeding of the thermal paper sheet 1 advances and a printing start position on the rear surface 1*b* based on driving of the second thermal head 4 enters a state corresponding to the first thermal head 2, driving of the first thermal head 2 in accordance with the first printing data D1 is started.

Figure 10:
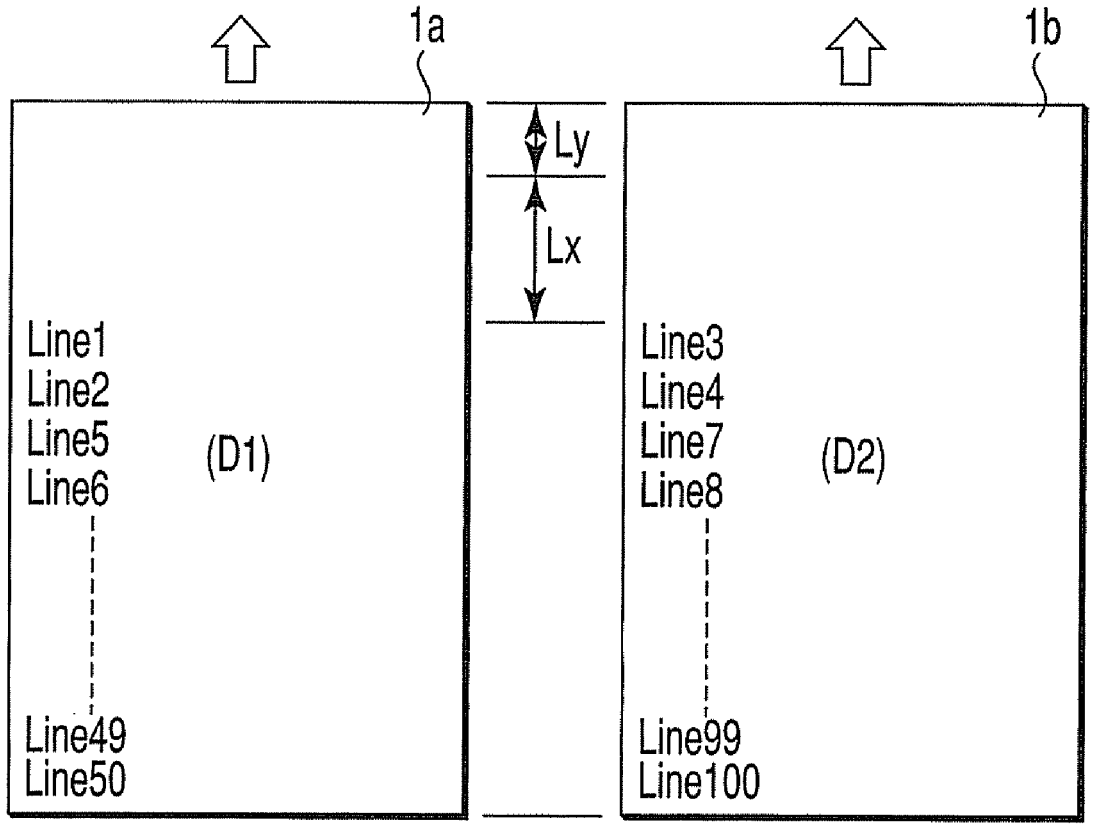
FIG. 10 is a view showing a printing result in a fourth operation mode in the first embodiment.

In this manner, as shown in FIG. 10, the second printing data D2, in which the pieces of printing data each of which corresponds to two rows are sequentially arranged, is printed on the rear surface 1*b* of the thermal paper sheet 1, and the first printing data D1, in which the pieces of printing data each of which corresponds to two rows are sequentially arranged, is printed on the front surface 1*a* of the thermal paper sheet 1. The blank region Ly and the blank region Lx are generated on the distal end side of each of the rear surface 1*b* and the front surface 1*a*.

The printed thermal paper sheet 1 is cut by the cutter 6 to be provided to a user.

When an amount of the printing data D0 is less than a predetermined amount, all of the printing data D0 is set as one of the first printing data D1 and the second printing data D2.

As explained above, the thermal paper sheet 1 having the heat-sensitive layers on both surfaces thereof is prepared, and the first thermal head 2, which comes into contact with the front surface 1*a* of the thermal paper sheet 1, and the second thermal head 4, which comes into contact with the rear surface 1*b* of the same, are provided. The printing data D0 input from the host device 30 is divided into the first printing data D1 and the second printing data D2, and the thermal heads 2 and 4 are driven in accordance with these printing data D1 and D2. As a result, the printing data D0 can be divided and rapidly printed on the front surface 1*a* and the rear surface 1*b* of the thermal paper sheet 1.

Therefore, even if an amount of the printing data D0 is large, the length of the thermal paper sheet 1 on which the data is to be printed can be reduced. When the thermal paper sheet 1 is used as a sales receipt at, e.g., a store, many pieces of commodity purchase data can be all printed on the short receipt, and hence the thermal paper sheet 1 is easy to handle for users. This also saves thermal paper.

When the host device 30 is connected with a single-side printing type thermal printer, a simple replacement of this thermal printer with the thermal printer according to this embodiment easily allows executing processing of dividing the printing data D0 and double-side printing processing without changing hardware and software on the host device 30 side. Since the thermal printer alone is replaced, functions can be enhanced while suppressing a cost on the user side to the minimum level.

[2] Second Embodiment

Figure 11:
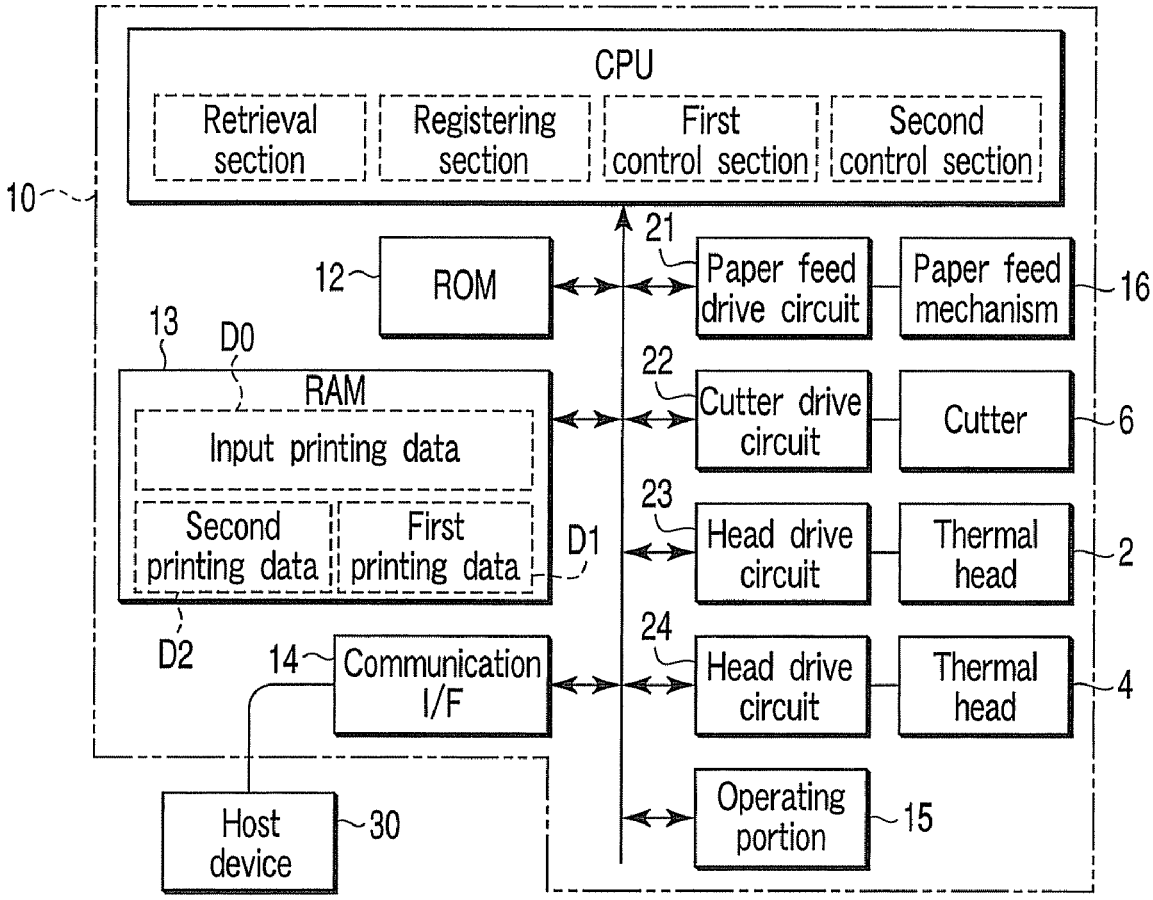
FIG. 11 is a block diagram showing a control circuit in a second embodiment.

A second embodiment according to the present invention will now be explained with reference to the accompanying drawings. The basic structure is the same as that shown in FIG. 1, thereby omitting an explanation thereof. FIG. 11 shows a control circuit of a thermal printer main body 10.

A CPU 11 has the following means (11) to (14) as primary functions.

(11) A retrieving section of retrieving printing data Dm corresponding to a previously registered keyword from printing data D0 input from an external host device 30. The keyword is at least one item included in printing data to be printed on one surface of a thermal paper sheet 1.

(12) A registering section of registering the keyword in accordance with an operation of an operating portion 15.

(13) A first control section of dividing the input printing data D0 into first printing data D1 for a first thermal head 2 including the retrieved printing data Dm and second printing data D2 for a second thermal head 4 that does not include the retrieved printing data Dm. The printing data D0, the first printing data D1, and the second printing data D2 are all stored in an RAM 13.

(14) A second control section of first starting driving of the second thermal head 4 in accordance with the second printing data D2 while feeding the thermal paper sheet 1, and starting driving of the first thermal head 2 in accordance with the first printing data D1 when a printing start position based on the first driving corresponds to the first thermal head 2.

Other structures are the same as those in the first embodiment. Therefore, an explanation thereof will be omitted.

Figure 12:
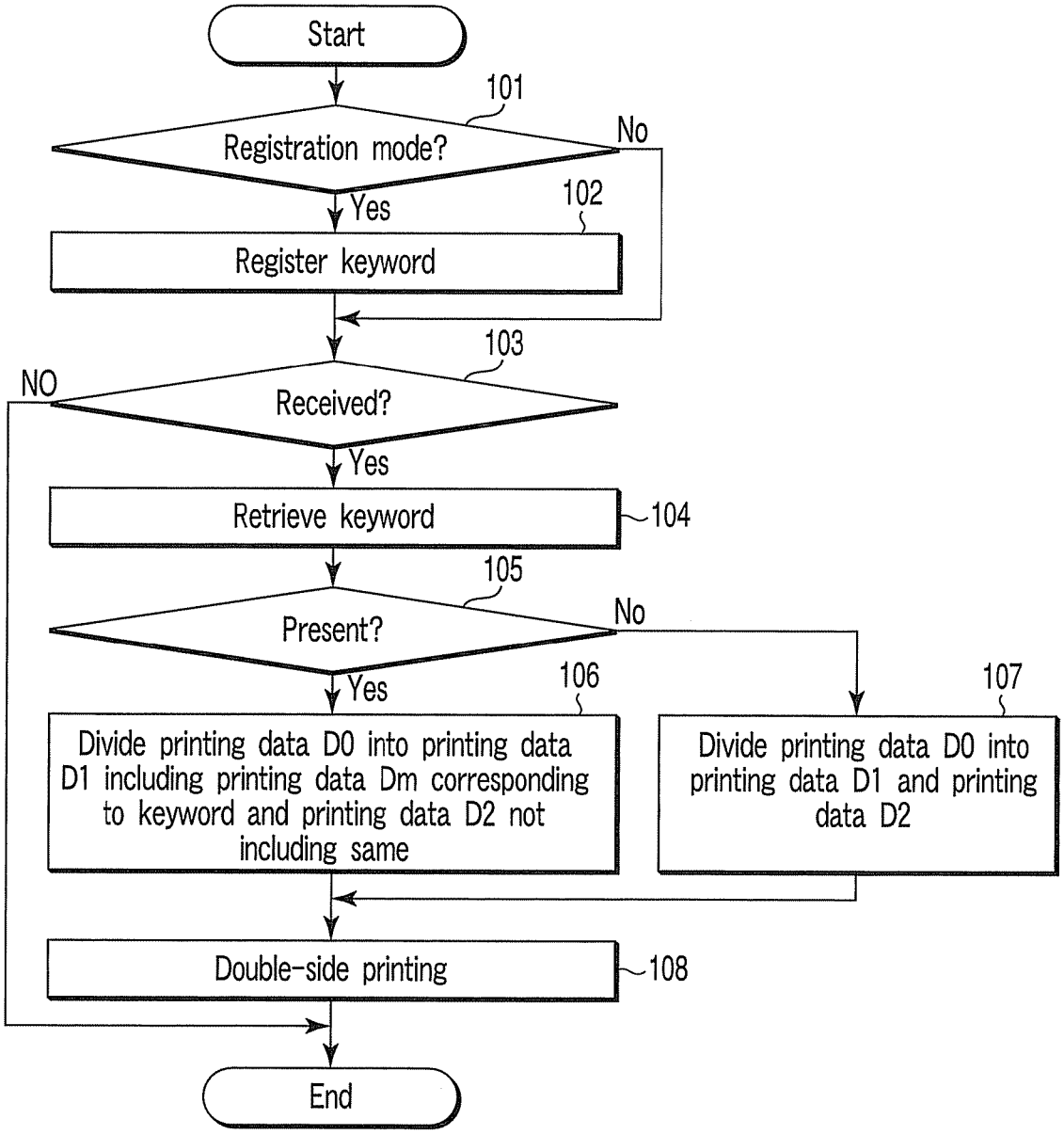
FIG. 12 is a flowchart for explaining a function of the second embodiment.

A function will now be explained with reference to a flowchart of FIG. 12.

When a registration mode of a keyword is set by the operating portion 15 (YES at a step 101), an item included in primary printing data to be printed on one surface of the thermal paper sheet 1, e.g., "total amount", "received amount", or "change" can be registered (stored) as a keyword in the RAM 13 by an operation of the operating section 15 (a step 102).

When the printing data D0 transmitted from an external host device 30 is received by this thermal printer (YES at a step 103), the printing data D0 is stored in the RAM 13. At this time, the printing data Dm corresponding to the previously registered keyword is retrieved from the printing data D0 (a step 104).

Figure 13:
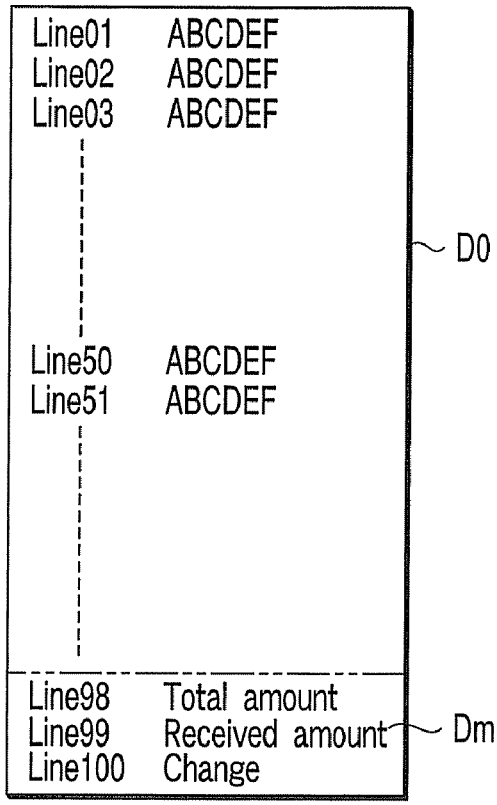
FIG. 13 is a view showing a format of printing data D0 in the second embodiment.

FIG. 13 shows an example of the printing data D0. This printing data D0 is formed of printing data from a first row to a 100th row. In particular, data from a 98th row to the 100th row at a lowermost part corresponds to printing data of "total amount", printing data of "received amount", and printing data of "change". Namely, these three pieces of printing data is the printing data Dm corresponding to the keywords.

When the printing data Dm is found by retrieval (YES at a step 105), the printing data D0 is divided into the first printing data D1 including the printing data Dm and the second printing data D2 that does not include the printing data Dm (a step 106).

Figure 14:
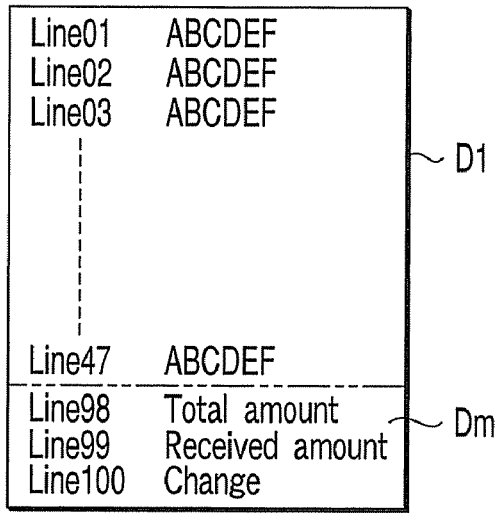
FIG. 14 is a view showing a format of printing data D1 (including Dm) in the second embodiment.
Figure 15:
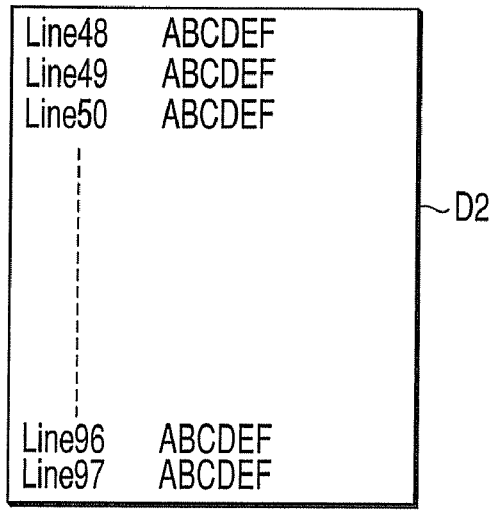
FIG. 15 is a view showing a format of printing data D2 in the second embodiment.

That is, as shown in FIG. 14, the first printing data D1 having the printing data Dm as the printing data from the 98th row to the 100th row added after printing data from the first row to a 47th row is generated. Additionally, as shown in FIG. 15, the second printing data D1 formed of remaining printing data from a 48th row to the 97th row is produced. The generated first printing data D1 and second printing data D2 are stored in the RAM 13.

After this division, feeding of the thermal paper sheet 1 is started, and driving of the second thermal head 4 in accordance with the second printing data D2 is first started, whereby the printing data from the 48th row to the 97th row is printed on the rear surface 1*b* of the thermal paper sheet 1. When feeding of the thermal paper sheet 1 advances and a printing start position on the rear surface 1*b* side based on driving of the second thermal head 4 enters a state corresponding to the first thermal head 2, driving of the first thermal head 2 in accordance with the first printing data D1 is started, thereby printing the printing data from the first row to the 47th row and the printing data from the 98th row to the 100th row on the front surface 1*a* of the thermal paper sheet 1 (a step 108).

Figure 16:
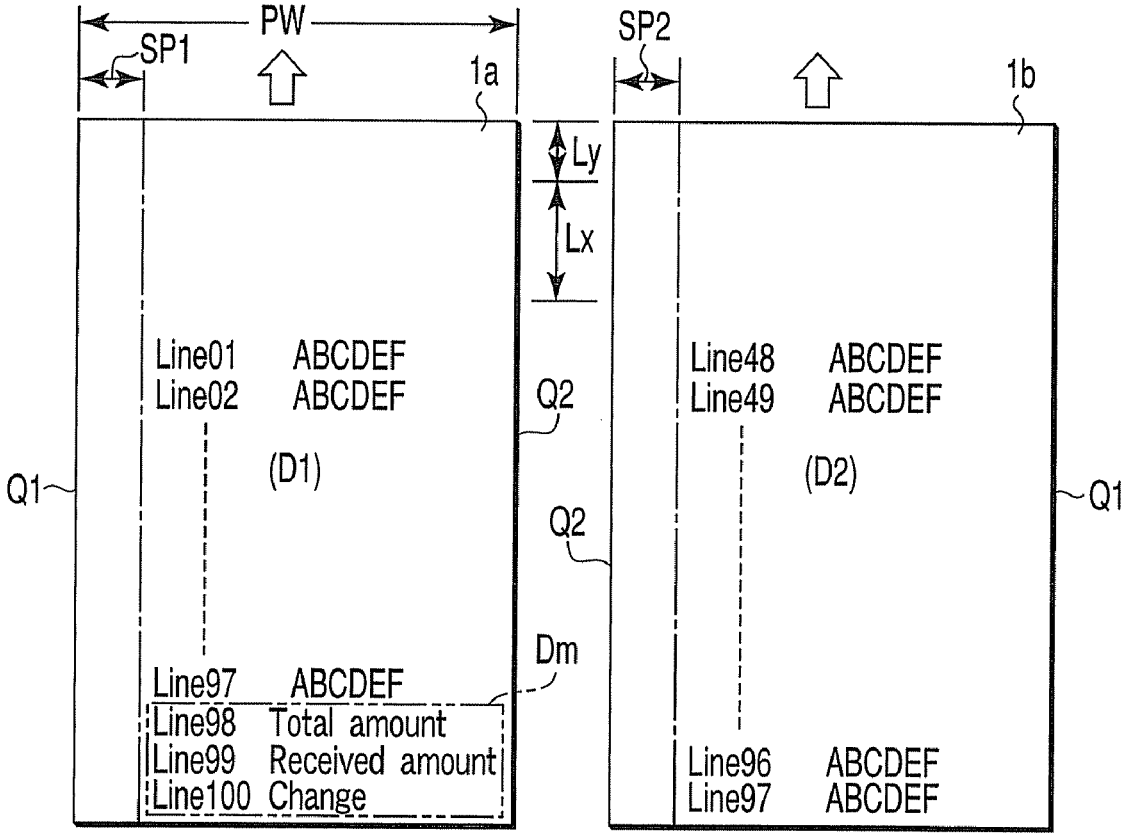
FIG. 16 is a view showing a printing result in the second embodiment.

In this manner, as shown in FIG. 16, the printing data as the first printing data D1 having the printing data Dm at the lowermost part is printed on the front surface 1*a* of the thermal paper sheet 1, and the printing data as the second printing data D2 is printed on the rear surface 1*b* side of the thermal paper sheet 1.

In this case, on the front surface 1*a* of the thermal paper sheet 1, a blank region having a width SP1 is assured between a start position of each character row to be printed and one end Q1 in a width direction. On the rear surface 1*b* of the thermal paper sheet 1, a blank region having a width SP2 is assured between a start position of each character row to be printed and the other end Q2 in the width direction. Further, on a distal end side of each of the front surface 1*a* and the rear surface 1*b*, a blank region Ly corresponding to a distance Y from a cutter 6 to the first thermal head 2 is produced, and a blank region Lx corresponding to a distance X from the first thermal head 2 to the second thermal head 4 is generated.

The printed thermal paper sheet 1 is cut by the cutter 6 to be provided to a customer as a sales receipt. On the sales receipt, "total amount", "received amount", and "change" as important data are printed at noticeable positions on the front surface 1*a* side.

When the printing data Dm cannot be found by the retrieval (NO at the step 105), the printing data D0 is divided into the first printing data D1 and the second printing data D2 (a step 107). Furthermore, printing data as the first printing data D1 is printed on the front surface 1*a* of the thermal paper sheet 1, and printing data as the second printing data D2 is printed on the rear surface 1*b* of the thermal paper sheet 1.

As explained above, the printing data D0 input from the host device 30 can be divided and rapidly printed on the front surface 1*a* and the rear surface 1*b* on the thermal paper sheet 1.

In particular, when the printing data Dm formed of printing data "total amount", "received amount", and "change" is retrieved based on the previously registered keywords and the printing data Dm is found, the first printing data D1 including the printing data Dm is printed on the front surface 1*a* of the thermal paper sheet 1. Therefore, even if an amount of the printing data D0 is large and the thermal paper sheet 1 on which the data is to be printed is long, the data important for a customer can be appropriately provided in an easy-to-read format.

It is to be noted that the above has explained the example where the printing data Dm is incorporated into the lowermost part of the first printing data D1, but the present invention is not restricted to this incorporating position, and the printing data Dm may be incorporated into, e.g., an uppermost part. Furthermore, the keywords are not restricted to "total amount", "received amount", and "change", and the keywords may be registered and changed in many ways.

Other functions and effects are the same as those in the first embodiment. Therefore, an explanation thereof will be omitted.

[3] Third Embodiment

A third embodiment according to the present invention will now be explained with reference to the accompanying drawings. The basic structure is the same as that shown in FIG. 1.

Figure 20:
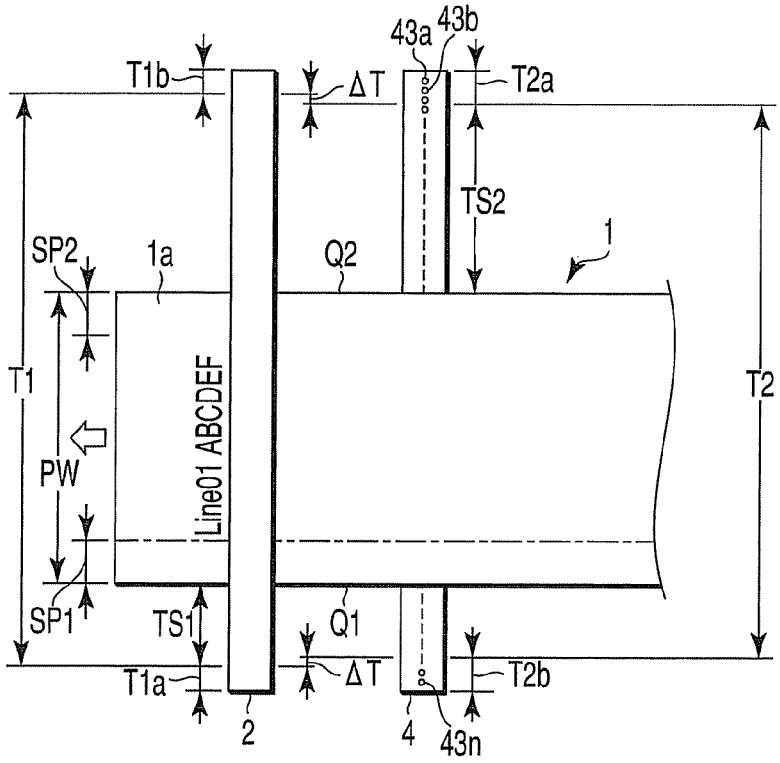
FIG. 20 is a view showing a printing region of a first thermal head from a front surface side of a thermal paper sheet in the third embodiment.
Figure 21:
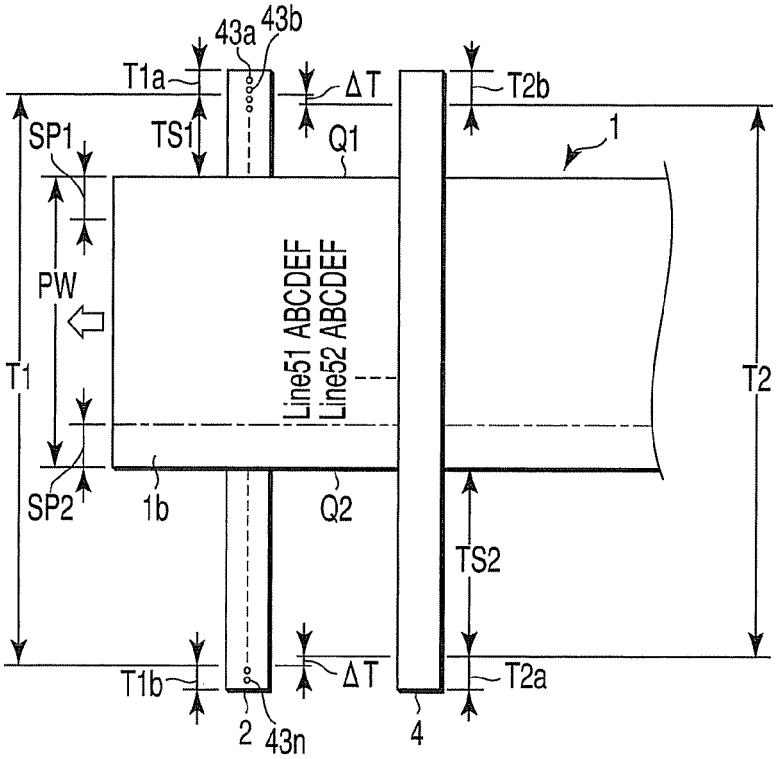
FIG. 21 is a view showing a printing region of a second thermal head from a rear surface side of the thermal paper sheet in the third embodiment.
Figure 22:
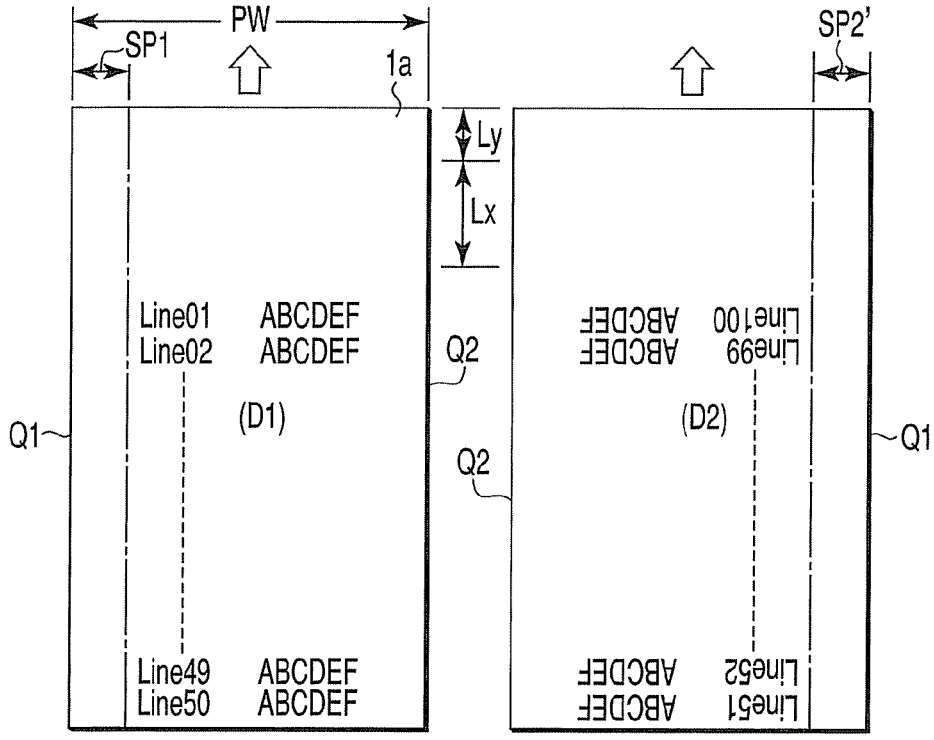
FIG. 22 is a view showing another printing result in the third embodiment.

Moreover, as shown in FIGS. 20 and 21, a first thermal head 2 has operation disabled regions with predetermined widths T1*a* and T1*b* where sufficient heating at the time of printing is impossible at one end and the other end, and has an operation enabled region T1 between both the operation disabled regions. A second thermal head 4 also has operation disabled regions with predetermined widths T2*a* and T2*b* where sufficient heating at the time of printing is impossible at one end and the other end, and has an operation enabled region T2 between both the operation disabled regions.

Figure 17:
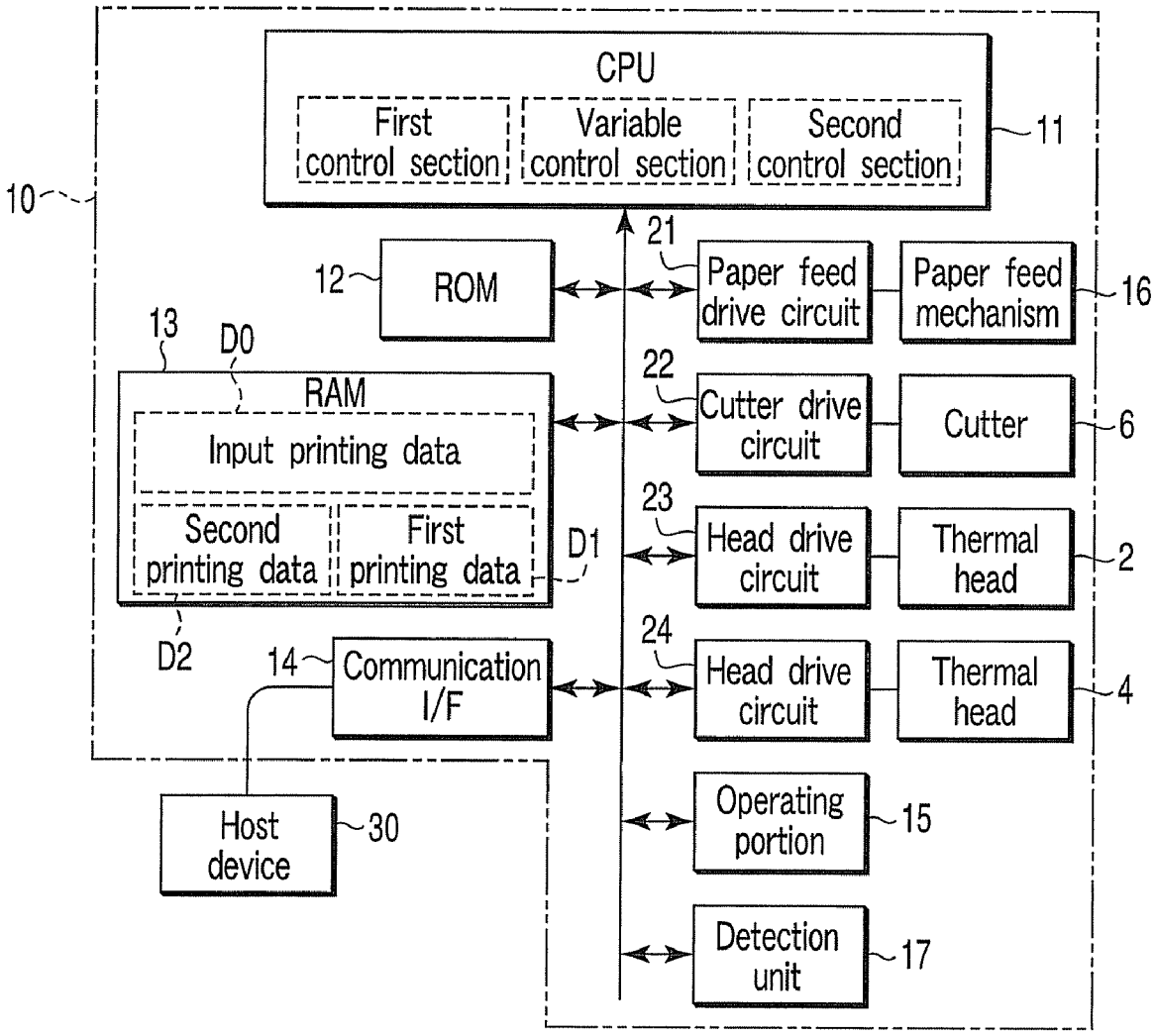
FIG. 17 is a block diagram of a control circuit in a third embodiment.

FIG. 17 shows a control circuit of a thermal printer main body 10.

That is, a detection unit 17 is connected with a CPU 11. The detection unit 17 optically or mechanically detects a width PW of the thermal paper sheet 1 in a direction perpendicular to a paper feed direction of the thermal paper sheet 1 and a position of the thermal paper sheet 1 in a direction perpendicular to the paper feed direction of the same.

Additionally, the CPU 11 includes the following means (21) to (23) as primary functions.

(21) A first control section of dividing printing data D0 input from an external host device 30 into first printing data D1 for a first thermal head 2 and second printing data D2 for a second thermal head 4. The printing data D0, the first printing data D1, and the second printing data D2 are all stored in an RAM 13.

(22) A variable control section of variably controlling a printing region of the first thermal head 2 in accordance with a detection result of the detection unit 17 (a position and a width of the thermal paper sheet 1 in a direction perpendicular to the paper feed direction of the thermal paper sheet 1), and variably controlling a printing region of the second thermal head 4 in accordance with a detection result of the detection unit 17.

(23) A second control section of first starting driving of the second thermal head 4 in accordance with the second printing data D2 while feeding the thermal paper sheet 1, and starting driving of the first thermal head 2 in accordance with the first printing data D1 when a printing start position based on the first driving corresponds to the first thermal head 2.

Other structures are the same as those in the first embodiment. Therefore, an explanation thereof will be omitted.

A function will now be described.

When the printing data D0 is input to this thermal printer from the external host device 30, the printing data D0 is stored in the RAM 13. With this storage, the printing data D0 is divided into the first printing data D1 and the second printing data D2. An amount or conditions of the division are set based on an operation of an operating portion 15*b* or an instruction from the host device 30. There is "50% to 50%" as an amount of the division, and there is a data type as conditions of the division, for example. As data types, in case of a sales receipt at a store, there are a money character, an information text for customers, an advertising text, an illustration, and others, for example.

Figure 18:
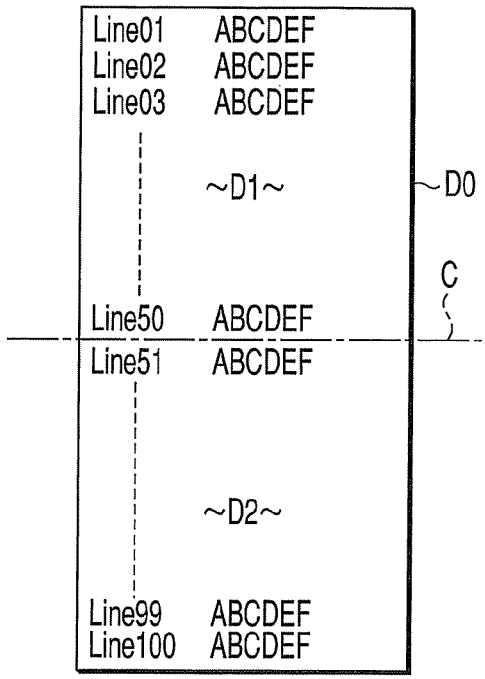
FIG. 18 is a view showing a format of printing data D0 in the third embodiment.

FIG. 18 shows an example where the printing data D0 is divided into the first printing data D1 and the second printing data D2.

That is, the printing data D0 formed of printing data from a first row to a 100th row is divided into the first printing data D1 constituted of printing data from the first row to a 50th row and the second printing data D2 constituted of printing data from a 51st row to the 100th row, with a boundary position C at the center being determined as a boundary. The divided first printing data D1 and second printing data D2 are stored in the RAM 13. When data is present at the boundary position C, this data is distributed as one of the first printing data D1 and the second printing data D2 in accordance with predetermined conditions.

After this division, feeding of the thermal paper sheet 1 is started, and driving of the second thermal head 4 in accordance with the second printing data D2 is first commenced, whereby the printing data from the 51st row to the 100th row is printed on a rear surface 1*b* of the thermal paper sheet 1. When feeding of the thermal paper sheet 1 advances and a printing start position on the rear surface 1*b* side based on driving of the second thermal head 4 enters a state corresponding to the first thermal head 2, driving of the first thermal head 2 in accordance with the first printing data D1 is started, thereby printing the printing data from the first row to the 50th row on a front surface 1*a* of the thermal paper sheet 1.

Figure 19:
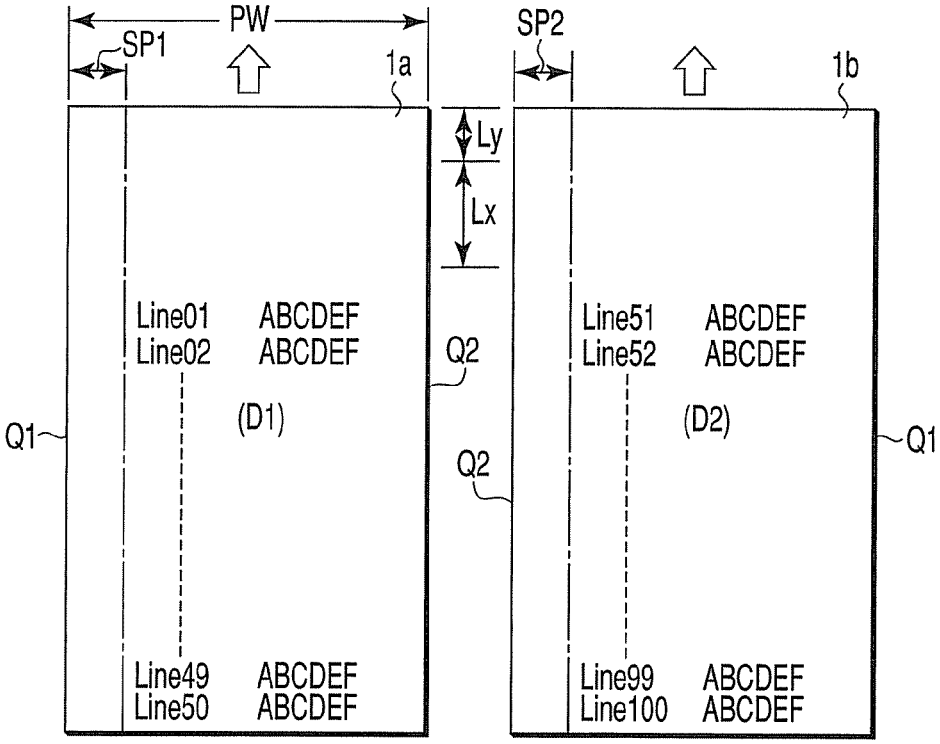
FIG. 19 is a view showing a printing result in the third embodiment.

In this manner, as shown in FIG. 19, the printing data from the first row to the 50th row as the first printing data D1 is printed on the front surface 1*a* of the thermal paper sheet 1, and the printing data from the 51st row to the 100th row as the second printing data D2 is printed on the rear surface 1*b* of the thermal paper sheet 1. In this case, on the front surface 1*a* of the thermal paper sheet 1, a blank region having a width SP1 is assured between a start position of each character row to be printed and one end Q1 in a width direction. On the rear surface 1*b* of the thermal paper sheet 1, a blank region having a width SP2 is assured between a start position of each character row to be printed and the other end Q2 in the width direction.

On a distal end side of each of the front surface 1*a* and the rear surface 1*b*, a blank region Ly corresponding to a distance Y from a cutter 6 to the first thermal head 2 is generated, and a blank region Lx corresponding to a distance X from the first thermal head 2 to the second thermal head 4 is produced.

The printed thermal paper sheet 1 is cut by the cutter 6 to be provided to a user.

FIGS. 20 and 21 show a relationship between the first and the second thermal heads 2 and 4 and the thermal paper sheet 1 in this printing. FIG. 20 shows a state of a printing region of the first thermal head 2 corresponding to the front surface 1*a* from the front surface 1*a* side. FIG. 21 shows a state of a printing region of the second thermal head 4 corresponding to the rear surface 1*b* from the rear surface 1*b* side.

In FIGS. 20 and 21, heating elements 43*a*, 43*b*, . . . 43*n* of the first and the second thermal heads 2 and 4 are just schematically shown. Actual shapes of the heating elements 43*a*, 43*b*, . . . 43*n* are very small.

Settings of the printing region of the first thermal head 2 with respect to the front surface 1*a* will be first explained with reference to FIG. 20.

When one end (the T1*a* side) of the operation enabled region T1 of the first thermal head 2 is determined as a reference position, one end (a starting position of each character row) of the printing region of the first thermal head 2 is set at a position of a distance obtained by adding a distance TS1 from the reference position to the one end Q1 of the thermal paper sheet 1 in the width direction and the width SP1 of the blank region.

The one end of the printing region of the first thermal head 2=(the reference position)+TS1+SP1

The other end (the T1*b* side) of the printing region of the first thermal head 2 is set in accordance with the width PW of the thermal paper sheet 1.

Settings of the printing region of the second thermal head 4 with respect to the rear surface 1*b* will now be explained with reference to FIG. 21.

When one end (the T2*a* side) of the operation enabled region T2 of the second thermal head is determined as a reference position, one end (a starting position of each character row) of the printing region of the second thermal head 4 is set at a position of a distance obtained by adding a distance TS2 from the reference position to the other end Q2 of the thermal paper sheet 1 in the width direction and the width SP2 of the blank region.

The one end of the printing region of the second thermal head 4=(the reference position)+TS2+SP2

The other end (the T2*b* side) of the printing region of the second thermal head 4 is set in accordance with the width PW of the thermal paper sheet 1.

It is to be noted that the one end (the starting position of each character row) of the printing region of the second thermal head 4 with respect to the rear surface 1*b* can be set based on the following expression in which one end (the T2*a* side) of the operation enabled region T2 of the second thermal head 4 is determined as a reference position. AT is a difference between the one end (the T1*a* side) of an effective operating region T1 of the first thermal head 2 and the other end (the T2*b* side) of an effective operating region T2 of the second thermal head 4.

The one end of the printing region of the second thermal head 4=(the reference position)+T2−[(TS1−ΔT)+PW]+SP2

On the other hand, switching an operation mode by the operating portion 15 allows performing printing in a regular direction on the front surface 1*a* side of the thermal paper sheet 1 and allows effecting printing in a vertically inverted direction on the rear surface 1*b* side.

In this case, on the front surface 1*a* of the thermal paper sheet 1, the blank region having the width SP1 is assured between the starting position of each character row to be printed and the one end Q1 in the width direction. On the rear surface 1*b* of the thermal paper sheet 1, a blank region having a width SP2' (=SP1) is assured between the starting position of each character row to be printed and the one end Q1 in the width direction.

Figure 23:
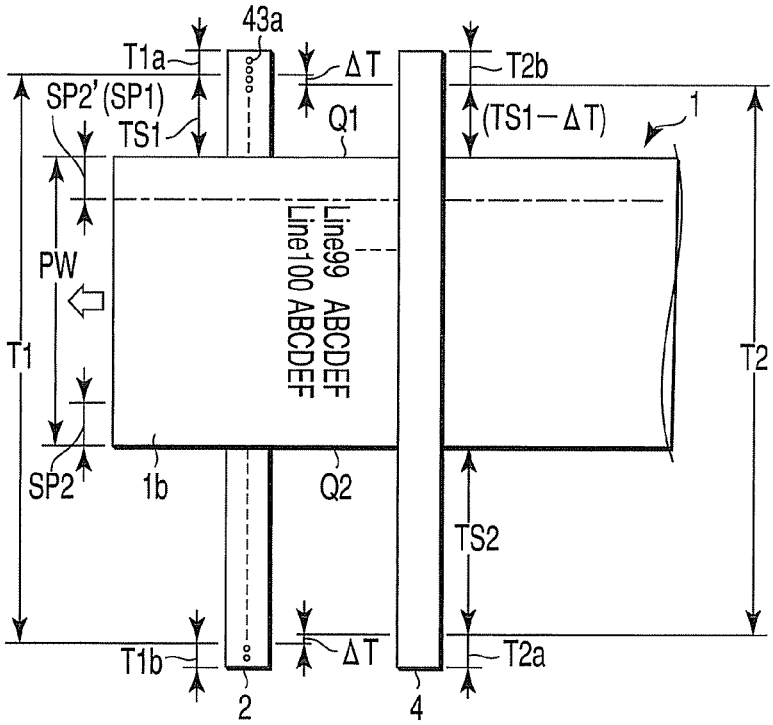
FIG. 23 is a view showing a relationship between each thermal head and the thermal paper sheet from the rear surface side of the thermal paper sheet at the time of printing in FIG. 22.

In case of this printing, a printing position of the first thermal head 2 is the same as that shown in FIG. 20, and a printing position of the second thermal head 4 is as shown in FIG. 23.

Settings of the printing region of the second thermal head 4 with respect to the rear surface 1*b* will now be explained with reference to this FIG. 23.

When the other end (the T2*b* side) of the operation enabled region T2 of the second thermal head is determined as a reference position, one end (the starting position of each character row) of the printing region of the second thermal head 4 is set at a position of a distance obtained by adding a distance from the reference position to the one end Q1 of the thermal paper sheet 1 in the width direction (=TS1−ΔT) and the width SP2' (=SP1) of the blank region.

The one end of the printing region of the second thermal head 4=(the reference position)+(TS1−ΔT)+SP2'

The one end (the T2*a* side) of the printing region of the second thermal head 4 is set in accordance with the width PW of the thermal paper sheet 1.

Furthermore, the one end (the starting position of each character row) of the printing region of the second thermal head 4 with respect to the rear surface 1*b* can be set based on the following expression where one end (the T2*a* side) of the operation enabled region T2 of the second thermal head 4 is determined as a reference position.

The one end of the printing region of the second thermal head 4=(the reference position)+T2−(TS1−ΔT)−SP2'

Moreover, when the one end (the T2*a* side) of the operation enabled region T2 of the second thermal head 2 is determined as a reference position, the one end (the starting position of each character row) of the printing region of the second thermal head 4 with respect to the rear surface 1*b* can be set based on the following expression using a distance TS2 from the reference position to the other end Q2 of the thermal paper sheet 1 in the width direction.

The one end of the printing region of the second thermal head 4=(the reference position)+TS2+PW−SP2'

As explained above, the first and the second thermal heads 2 and 4 that perform printing on the front surface 1*a* and the rear surface 1*b* of the thermal paper sheet 1 having heat-sensitive layers on both surfaces thereof are provided, and the printing regions of the thermal heads 2 and 4 are variably controlled in accordance with a width and a position of the thermal paper sheet 1 in a direction perpendicular to the paper feed direction of the thermal paper sheet 1. As a result, even if a width dimension or a set position of the thermal paper sheet 1 varies, adequate high-speed double-side printing can be performed with respect to thermal paper sheet 1 without displacement.

It is to be noted that a position and a width of the thermal paper sheet 1 are both detected by the detection unit 17, but a position alone of the thermal paper sheet 1 may be detected by the detection unit 17. In regard to a width of the thermal paper sheet 1, a value that is set up by the operating portion 15 or a value instructed from the host device 30 may be previously stored in the RAM 13 as a storage section.

Other functions and effects are the same as those in the first embodiment. Therefore, an explanation thereof will be omitted.

[4] Fourth Embodiment

A fourth embodiment according to the present invention will now be explained with reference to the drawings. The basic structure is the same as that shown in FIG. 1.

Figure 24:
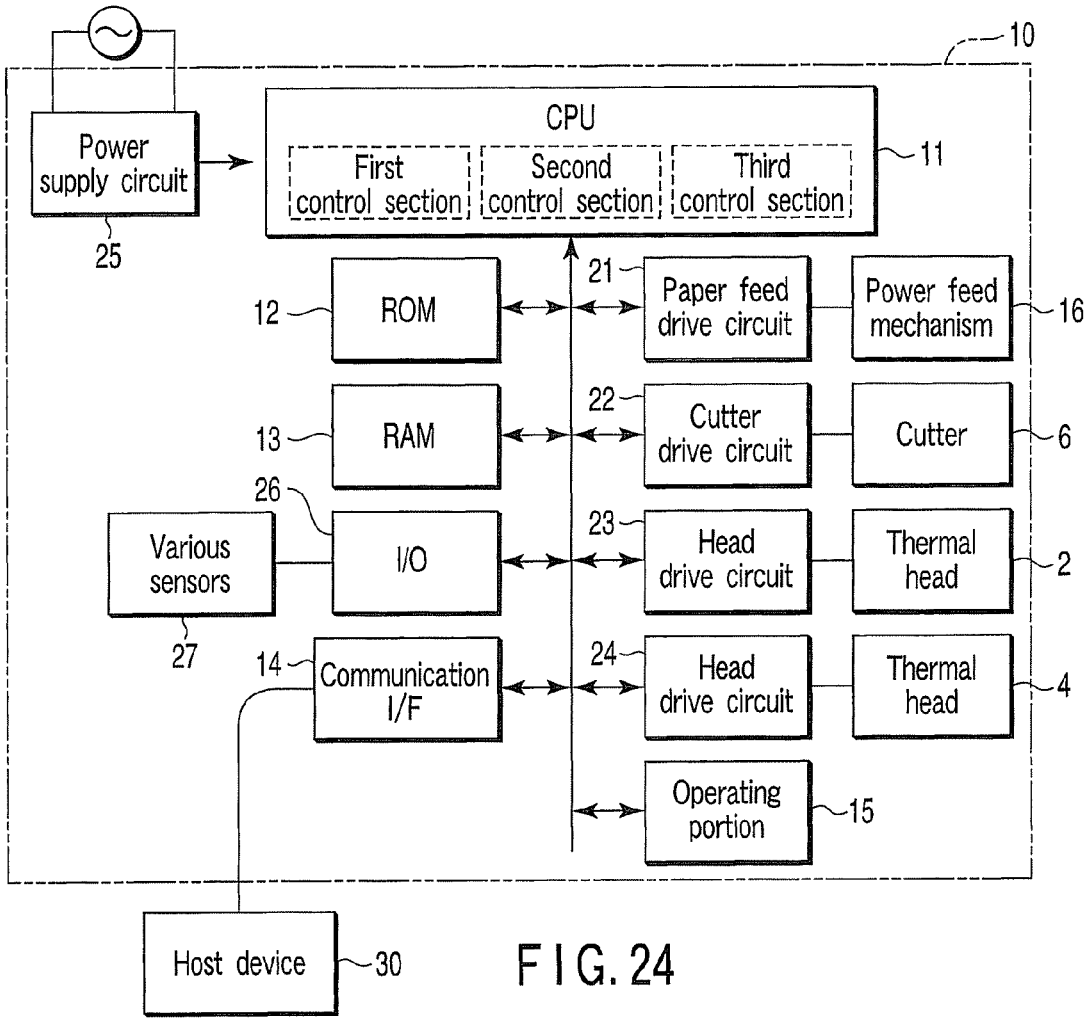
FIG. 24 is a block diagram of a control circuit in a fourth embodiment.

As shown in FIG. 24, a control circuit of a thermal printer main body 10 has a power supply circuit 25 that outputs an operation voltage. Further, an I/O (Input/Output) port 26 is connected with a CPU 11, and various kinds of sensors 27 of the thermal printer main body 10 are connected with the I/O port 26.

The CPU 11 includes the following means (31) to (33) as primary functions.

Figure 25:
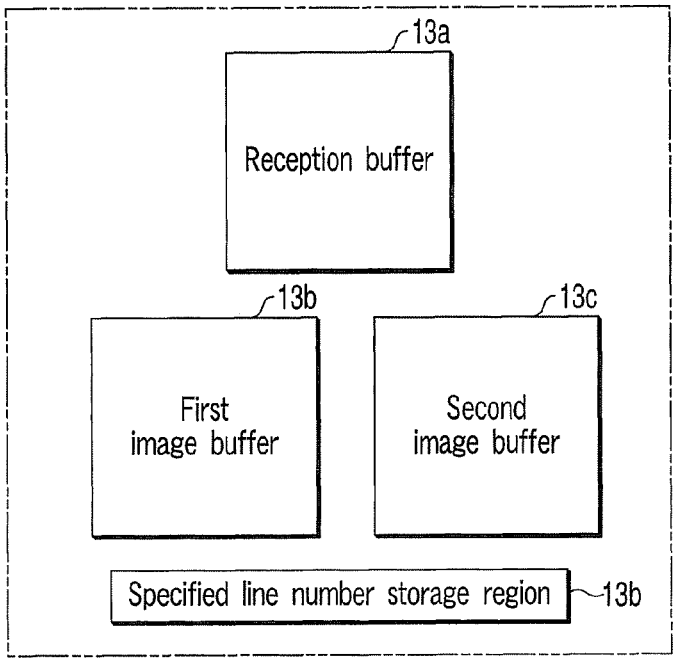
FIG. 25 is a view showing a structure of the inside of an RAM in the fourth embodiment.

(31) A first control section of sequentially dividing printing data D0 input from an external host device 30 into first raster image data D1 corresponding to a specified line number for a first thermal head 2 and second raster image data D2 corresponding to a specified line number for a second thermal head 4 and also alternately storing the data D1 and D2 in a first image buffer 13*b* and a second image buffer 13*c* in an RAM 13 shown in FIG. 25. It is to be noted that the printing data D0 is stored in a reception buffer 13 in the RAM 13.

(32) A second control section of supplying each first raster image data corresponding to the specified line number and each second raster image data corresponding to the specified line number stored in the respective image buffers 13*b* and 13*c* to the first thermal head 2 and the second thermal head 4 in accordance with each storage.

(33) A third control section of setting the specified line numbers in accordance with an instruction from the host device 30 or an operation of an operating portion 15. The set specified line numbers are stored in a specified line number storage section 13*d* formed in the RAM 13.

It is to be noted that the first thermal head 2 is constituted of a latch circuit 41, an energization control circuit 42, and an edge head 43 as shown in FIG. 3. The edge head 43 has many thermal-transfer heating elements 43*a*, 43*b*, . . . 43*n* that are linearly arranged, and raster image data for one line (N dots) corresponding to the number of these heating elements can be printed at a time. The latch circuit 41 latches the first raster image data D1 supplied from a head drive circuit 23 for each line in accordance with a strobe signal STB fed from the head drive circuit 23. The energization control circuit 42 controls energization with respect to the heating elements 43*a*, 43*b*, . . . 43*n* of the edge head 43 in accordance with the first raster image data D1 in the latch circuit 41 at a timing where an enable signal ENB fed from the head drive circuit 23 becomes active. A structure of the second thermal head 4 is the same as that of the first thermal head 2. Therefore, an explanation thereof will be omitted.

Figure 26:
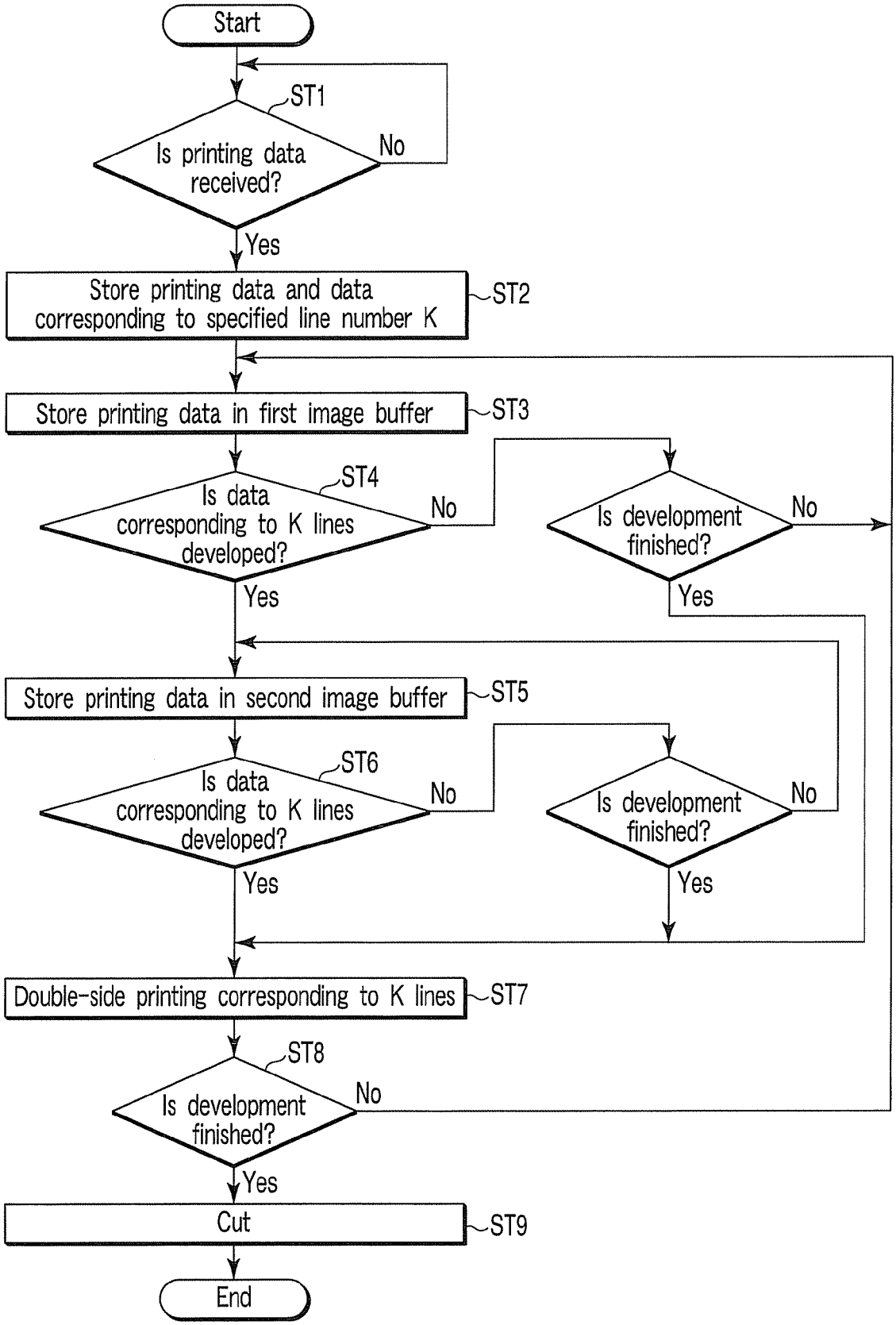
FIG. 26 is a flowchart for explaining a function of the fourth embodiment.

A function will now be explained with reference to a flowchart of FIG. 26.

When the printing data D0 supplied from the host device 30 is received (YES at a step ST1), the printing data D0 is stored in the reception buffer 13*a* of the RAM 13, and data of a specified line number K (=1, 2, 3, . . . ) added to the printing data D0 is updated and stored in the specified line number storage region 13*d* in the RAM 13 (a step ST2). It is to be noted that a rewritable non-volatile memory, e.g., an EEPROM may be provided separately from the RAM 13 to update and store the data of the specified line number K in this non-volatile memory. In this case, the data of the specified line number K is held without being erased even after a power supply is turned off.

The printing data D0 stored in the reception buffer 13*a* corresponding to the first specified line number K is stored in the first image buffer 13*b* while being sequentially developed from a top address (steps ST3 and ST4), and the printing data corresponding to the next specified line number K is stored in the second image buffer 13*c* (steps ST5 and ST6).

Upon completion of this storage, the first raster image data corresponding to the specified line number K in the first image buffer 13*b* is supplied to the first thermal head 2, and the second raster image data corresponding to the specified line number K in the second image buffer 13*c* is supplied to the second thermal head 4. Based on this supply, printing by the first thermal head 2 and printing by the second thermal head 4 are executed (a step ST7).

When development of all of the printing data D0 in the reception buffer 13*a* is not completed (NO at a step ST8), the printing data D0 corresponding to the next specified line number K in the reception buffer 13*a* is stored in the first image buffer 13*b* (the steps ST3 and ST4), and the printing data D0 corresponding to the next specified line number K is stored in the second image buffer 13*c* (the steps ST5 and ST6).

Upon completion of this storage, the first raster image data corresponding to the specified line number K in the first image buffer 13*b* is again supplied to the first thermal head 2, and the second raster image data corresponding to the specified line number K in the second image buffer 13*c* is supplied to the second thermal head 4. Based on this supply, printing by the first thermal head 2 and printing by the second thermal head 4 are executed (the step ST7).

It is to be noted that, when a last part of the printing data D0 does not meet the specified line number K, raster image data that does not meet the specified line number K is stored in the first image buffer 13*b* or the second image buffer 13*c*.

When development of all of the printing data D0 in the reception buffer 13*a* is terminated (YES at the step ST8), it is determined that printing has been terminated, and the thermal paper sheet 1 is cut by a cutter 6 (a step ST9).

Figure 27:
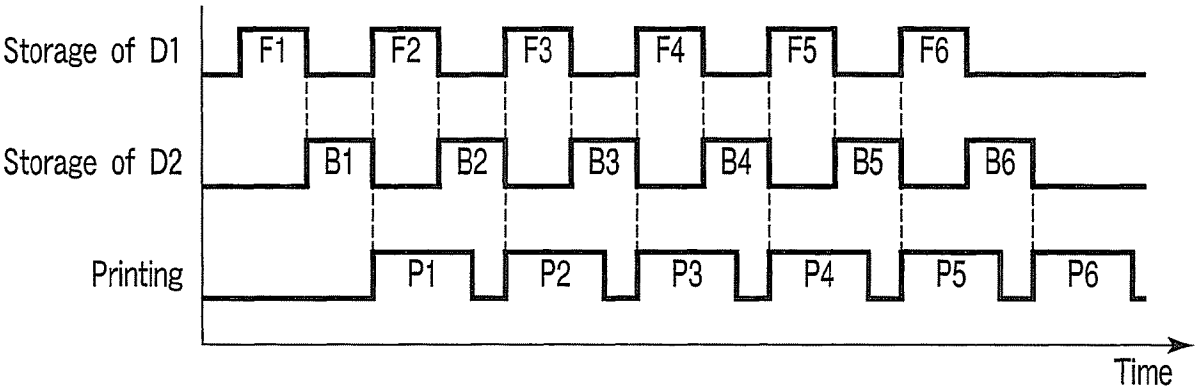
FIG. 27 is a view showing a storage timing of each raster image data and a printing timing of each thermal head in the fourth embodiment.

FIG. 27 shows a relationship between a timing at which each first raster image data D1 corresponding to the specified line number K is stored in the first image buffer 13*b*, a timing at which each second raster image data D2 corresponding to the specified line number K is stored in the second image buffer 13*c*, and timings of printing by the thermal heads 2 and 4. Moreover, FIG. 28 shows an example where all of the first raster image data D1 is first stored in the first image buffer 13*b*, the second raster image data D2 is then stored in the second image buffer 13*c*, and thereafter printing by the thermal heads 2 and 4 is executed for reference.

Figure 28:
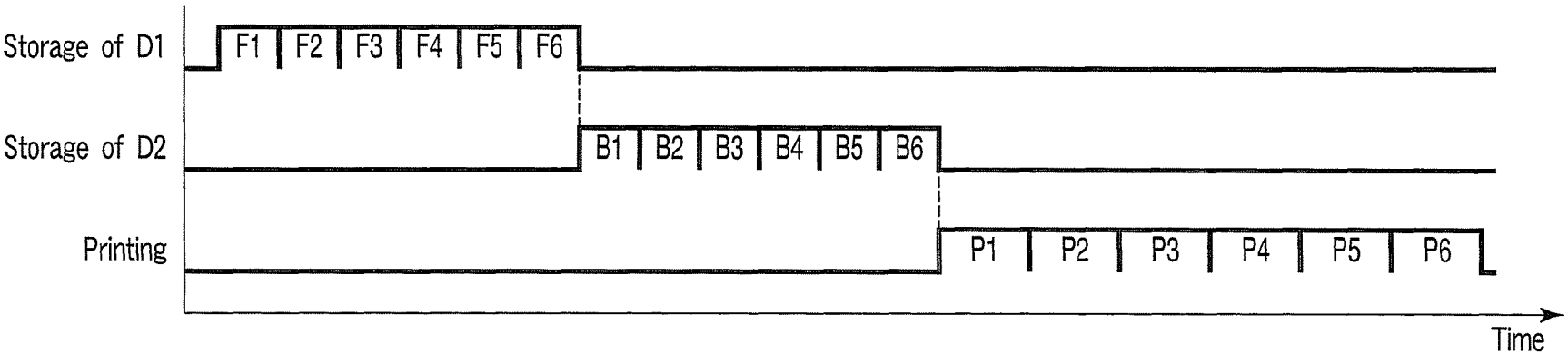
FIG. 28 is a view showing a reference example concerning FIG. 27.

F1, F2, F3, F4, F5, and F6 in FIGS. 27 and 28 denote times at which each first raster image data corresponding to the specified line number K is stored in the first image buffer 13*b*, respectively. B1, B2, B3, B4, B5, and B6 in FIGS. 27 and 28 designate times at which each second raster image data corresponding to the specified line number K is stored in the second image buffer 13*b*, respectively. P1, P2, P3, P4, P5, and P6 denote times required for printing by the thermal heads 2 and 4, respectively.

For example, when the specified line number K is "2", raster image data corresponding to two rows is alternately stored in the first image buffer 13*b* and the second image buffer 13*c*. The raster image data corresponding to two rows is printed on the front surface 1*a* of the thermal paper sheet 1 and the raster image data corresponding to two rows is printed on the rear surface 1*b* of the thermal paper sheet 1 in accordance with this storage. During this printing, development and storage of the raster image data with respect to the first image buffer 13*b* and the second image buffer 13*c* are also executed.

Therefore, a processing efficiency of printing with respect to the front surface 1*a* and the rear surface 1*b* of the thermal paper sheet 1 is improved, thereby greatly reducing a time required for printing.

Other functions and effects are the same as those in the first embodiment. Therefore, an explanation thereof will be omitted.

[5] Fifth Embodiment

A fifth embodiment according to the present invention will now be explained with reference to the accompanying drawings. The basic structure is the same as that shown in FIG. 1. A structure of a control circuit in a thermal printer main body 10 is the same as that depicted in FIG. 24 according to the fourth embodiment.

A CPU 11 includes the following means (41) to (43) as primary functions.

(41) A first control section of dividing printing data D0 input from an external host device 30 into first raster image data D1 corresponding to a plurality of lines for a first thermal head 2 and second raster image data D2 corresponding to a plurality of lines for a second thermal head 4, storing one of the first raster image data D1 and the second raster image data D2 in one of a first image buffer 1*b* and a second image buffer 1*c*, and then storing the remaining raster image data in the remaining image buffer. It is to be noted that the printing data D0 is stored in a reception buffer 13*a* in an RAM 13.

(42) A second control section of supplying the raster image data corresponding to a specified line number in one of the image buffers and the raster image data corresponding to the specified line number in the remaining image buffer to the first thermal head 2 and the second thermal head 4 every time the raster image data corresponding to the specified line number is stored in the remaining image buffer.

(43) A third control section of setting the specified line number in accordance with an instruction from the host device 30 or an operation of an operating portion 15. The set specified line number is stored in a specified line number storage region 13*d* formed in the RAM 13.

Figure 29:
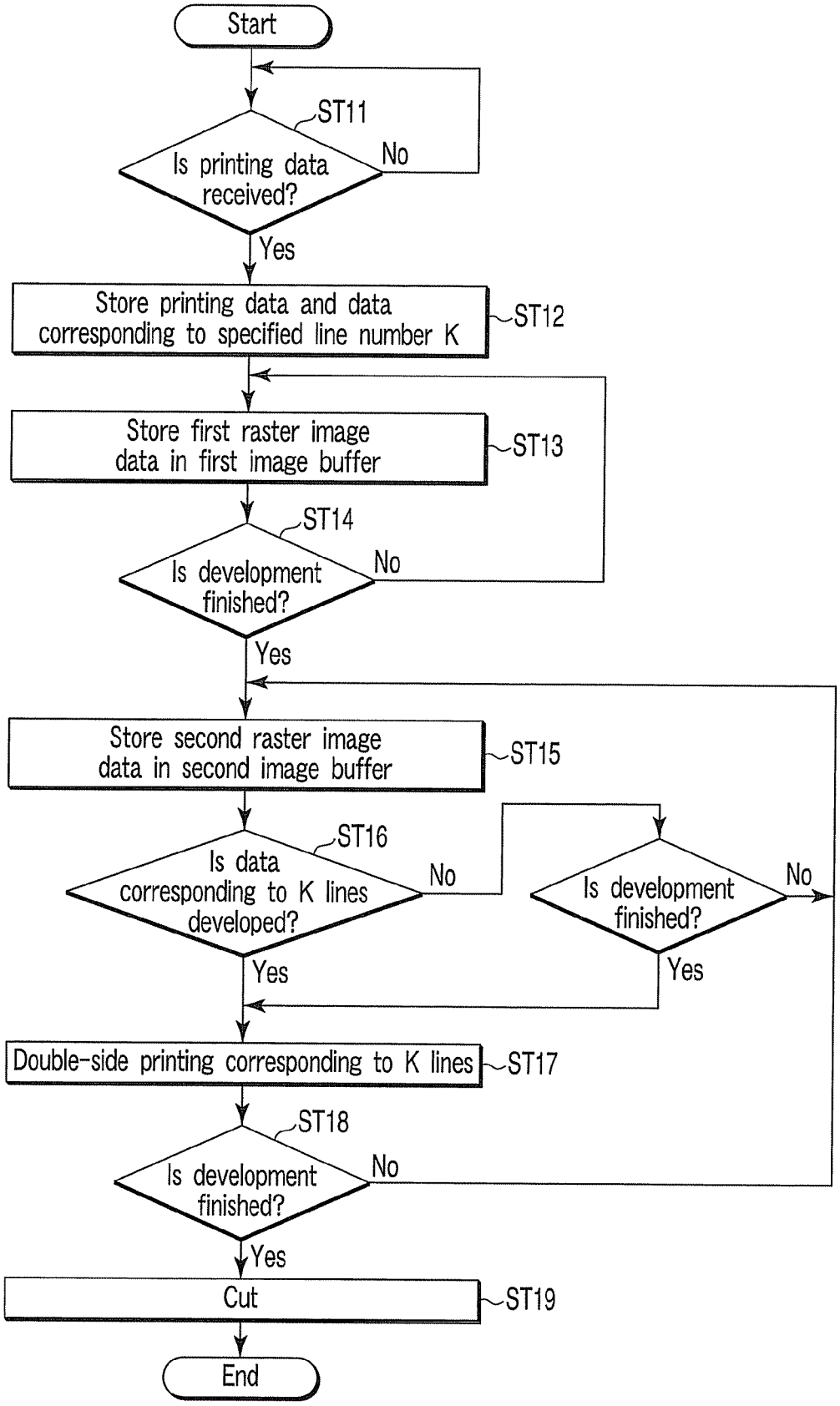
FIG. 29 is a flowchart for explaining a function of a fifth embodiment.

A function will now be explained with reference to a flowchart of FIG. 29.

When the printing data D0 supplied from the host device 30 is received (YES at a step ST1), the printing data D0 is stored in the reception buffer 13*a* in the RAM 13, and data of a specified line number K (=1, 2, 3, . . . ) added to the printing data D0 is updated and stored in the specified line number storage region 13*d* in the RAM 13 (a step ST12).

The first raster image data D1 for the first thermal head 2 is developed from the printing data D0 in the reception buffer 13*a*, and the first raster image data D1 is stored in the first image buffer 13*b* every specified line number K (steps ST13 and ST14).

Subsequently, the second raster image data D2 for the second thermal head 4 is developed from the remaining printing data D0 in the reception buffer 13*a*, and data of the second raster image data D2 corresponding to the specified line number K is stored in the second image buffer 13*c* (steps ST15 and ST16).

Every time the second raster image data corresponding to the specified line number K is stored in the second image buffer 130, the first raster image data corresponding to the specified line number K in the first image buffer 13*b* is supplied to the first thermal head 2, and the second raster image data corresponding to the specified line number K in the second image buffer 13*c* is supplied to the second thermal head 4. Based on this supply, printing by the first thermal head 2 and printing by the second thermal head 4 are executed (a step ST17).

When development of all of the second raster image data D2 is not completed (NO at a step ST18), the second raster image data D2 corresponding to the next specified line number K is stored in the second image buffer 13*c* (the steps ST15 and ST16).

Upon completion of this storage, the first raster image data corresponding to the specified line number K in the first image buffer 13*b* is again supplied to the first thermal head 2, and the second raster image data corresponding to the specified line number K in the second image buffer 13*c* is supplied to the second thermal head 4. Based on this supply, printing by the first thermal head 2 and printing by the second thermal head 4 are executed (the step ST17).

When development of all of the second raster image data D2 is terminated (YES at a step ST18), it is determined that printing is completed, and the thermal paper sheet 1 is cut by a cutter 6 (a step ST19).

Figure 30:
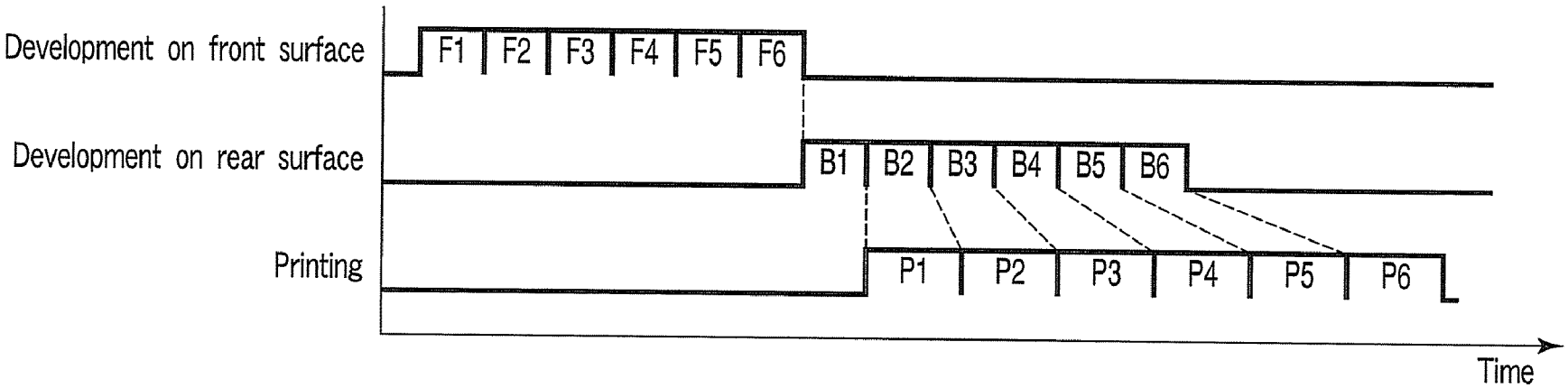
FIG. 30 is a view showing a storage timing of each raster image data and a printing timing of each thermal head in the fifth embodiment.

FIG. 30 shows a relationship between a timing at which each first raster image data D1 corresponding to the specified line number K is stored in the first image buffer 13*b*, a timing at which each second raster image data D2 corresponding to the specified line number K is stored in the second image buffer 13*c*, and timings of printing by the thermal heads 2 and 4.

F1, F2, F3, F4, F5, and F6 in FIG. 30 denote times at which each first raster image data corresponding to the specified line number K is stored in the first image buffer 13*b*, respectively. B1, B2, B3, B4, B5, and B6 in FIG. 30 designate times at which each second raster image data corresponding to the specified line number K is stored in the second image buffer 13*b*, respectively. P1, P2, P3, P4, P5, and P6 denote times required for printing by the thermal heads 2 and 4, respectively.

For example, when the specified line number K is "2", raster image data corresponding to two rows is stored in the second image buffer 13*c*. In accordance with this storage, the raster image data corresponding to two rows is printed on the front surface 1*a* of the thermal paper sheet 1, and the raster image data corresponding to two rows is printed on the rear surface 1*b* of the thermal paper sheet 1. During this printing, development and storage of the raster image data with respect to the second image buffer 13*c* are also executed.

Therefore, a processing efficiency of printing with respect to the front surface 1*a* and the rear surface 1*b* of the thermal paper sheet 1 is improved, thereby greatly reducing a time required for printing.

Other functions and effects are the same as those in the fourth embodiment. Therefore, an explanation thereof will be omitted.

It is to be noted that the above has described the example where the first raster image data D1 is stored in the first image buffer 1*b* and then the remaining second raster image data is stored in the second image buffer 1*c*. However, the second raster image data D2 may be stored in the second image buffer 1*c*, and then the remaining first raster image data D1 may be stored in the first image buffer 1*b*.

Further, the embodiments are not limited to a thermal printer using the thermal paper sheet 1 having the front surface and the rear surface on which the heat-sensitive layer is formed respectively. The embodiments of the present invention can also be applied to a thermal printer adopting a mechanism for feeding an ink ribbon between the thermal heads 2 and 4 and paper in order for the printer to accept a regular paper sheet and the like. Furthermore, the present invention is not restricted to the thermal printer, and it can be also applied to a dot printer, e.g., an inkjet printer or a dot impact printer.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer, comprising:

a thermal paper sheet which has heat-sensitive layers on a first surface and a second surface having a front-and-rear relationship, and is subjected to paper feed;

a first thermal head which prints on the first surface of the thermal paper sheet;

a second thermal head which prints on the second surface of the thermal paper sheet;

a first control section which divides printing data input from the outside into first printing data for the first thermal head and second printing data for the second thermal head;

a detection unit which detects a position of the thermal paper sheet in the direction perpendicular to the paper feed direction of the thermal paper sheet; and a storage section which previously stores a width of the thermal paper sheet in the direction perpendicular to the paper feed direction of the thermal paper sheet.

2. The thermal printer according to claim 1, wherein the first thermal head and the second thermal head are provided at positions separated from each other along a paper feed direction of the thermal paper sheet.

3. The thermal printer according to claim 2, wherein the first thermal head is present on a downstream side of the second thermal head in the paper feed direction.

4. The thermal printer according to claim 3, further comprising:

a second control section which first starts driving of the second thermal head in accordance with the second printing data while feeding the thermal paper sheet, and starts driving of the first thermal head in accordance with the first printing data when a printing start position based on the first driving corresponds to the first thermal head.

5. The thermal printer according to claim 3, further comprising:

a third control section which first starts driving of the first thermal head in accordance with the first printing data while feeding the thermal paper sheet, temporarily reverses the paper feed direction of the thermal paper sheet after end of the driving, and restores the paper feed direction of the thermal paper sheet to a normal state to start driving of the second thermal head in accordance with the second printing data when a printing start position based on driving of the first thermal head returns to a position corresponding to the second thermal head.

6. The thermal printer according to claim 3, further comprising:

a fourth control section which simultaneously starts driving of the first thermal head in accordance with the first printing data and driving of the second thermal head in accordance with the second printing data while feeding the thermal paper sheet.

7. The thermal printer according to claim 6, wherein, when the fourth control section simultaneously starts driving of the respective thermal heads, the first control section divides the printing data input from the outside into the first printing data and the second printing data based on an amount of the printing data that allows printing end positions of the respective thermal heads to become equal to each other.

8. The thermal printer according to claim 1, wherein the first control section alternately divides the printing data input from the outside into the first printing data and the second printing data in accordance with each predetermined amount.

9. The thermal printer according to claim 1, wherein the first control section divides the printing data input from the outside into the first printing data and the second printing data in accordance with each predetermined amount and, when data is present at a boundary position of the division, the first control section incorporates the data into one of the first printing data and the second printing data in accordance with predetermined conditions.

10. The thermal printer according to claim 1, wherein, when an amount of the printing data input from the outside is less than a predetermined amount, the first control section sets all of the printing data as one of the first printing data and the second printing data in accordance with predetermined conditions.

11. The thermal printer according to claim 1, further comprising:

a first platen roller which faces the first thermal head, with the thermal paper sheet interposed therebetween;

a second platen roller which faces the second thermal head, with the thermal paper sheet interposed therebetween; and a cutter which is provided on a downstream side of the respective thermal heads in a paper feed direction of the thermal paper sheet and cuts the thermal paper sheet subjected to printing by the respective thermal heads on a rear side of a printing position.

12. The thermal printer according to claim 1, further comprising:

a variable control section which variably controls printing regions of the respective thermal heads in accordance with a position and a width of the thermal paper sheet in a direction perpendicular to the paper feed direction of the thermal paper sheet.

13. The thermal printer according to claim 1, further comprising:

a detection unit which detects a position and a width of the thermal paper sheet in the direction perpendicular to the paper feed direction of the thermal paper sheet.

14. The thermal printer according to claim 13, wherein the variable control section variably controls the printing regions of the respective thermal heads in accordance with a detection result of the detection unit.

15. The thermal printer according to claim 1, wherein the variable control section variably controls the printing regions of the respective thermal heads in accordance with a detection result of the detection unit and storage contents of the storage section.

16. The thermal printer according to claim 1, wherein the respective thermal heads are provided in a state where they are perpendicular to the paper feed direction of the thermal paper sheet.

17. The thermal printer according to claim 16, wherein each of the thermal heads has a plurality of heating elements linearly arranged along the direction perpendicular to the paper feed direction of the thermal paper sheet.

18. The thermal printer according to claim 1, wherein the first control section divides the printing data input from the outside into first raster image data corresponding to a specified line number for the first thermal head and second raster image data corresponding to a specified line number for the second thermal head.

19. The thermal printer according to claim 18, further comprising:

a second control section which supplies each first raster image data and each second raster image data to be divided to the first thermal head and the second thermal head in accordance with each division.

20. The thermal printer according to claim 18, further comprising:

a third control section which sets the specified line number.

21. The thermal printer according to claim 1, further comprising:

a first image buffer and a second image buffer.

22. The thermal printer according to claim 21, wherein the first control section sequentially divides the printing data input from the outside into the first raster image data corresponding to the specified line number for the first thermal head and the second raster image data corresponding to the specified line number for the second thermal head and also alternately stores the respective divided image data in the respective image buffers.

23. The thermal printer according to claim 22, further comprising:

a second control section which supplies each first raster image data corresponding to the specified line number and each second raster image data corresponding to the specified line number to be stored in the respective image buffers to the first thermal head and the second thermal head in accordance with each storage.

24. The thermal printer according to claim 22, further comprising:

a third control section which sets the specified line number.

25. The thermal printer according to claim 21, wherein the first control section divides the printing data input from the outside into first raster image data corresponding to a plurality of lines for the first thermal head and second raster image data corresponding to a plurality of lines for the second thermal head, stores one of the first raster image data and the second raster image data in one of the first image buffer and the second image buffer, and then stores the remaining raster image data in the remaining image buffer.

26. The thermal printer according to claim 25, further comprising:

a second control section which supplies the raster image data corresponding to the specified line number in the one image buffer and the raster image data corresponding to the specified line number in the remaining image buffer to the first thermal head and the second thermal head every time the raster image data corresponding to the specified line number is stored in the remaining image buffer.

27. The thermal printer according to claim 26, further comprising:

a third control section which sets the specified line number.

28. A method of controlling a thermal printer according to claim 1, comprising:

dividing printing data input from the outside into first printing data for the first thermal head and second printing data for the second thermal head.

29. A thermal printer, comprising:

a thermal paper sheet which has heat-sensitive layers on a first surface and a second surface having a front-and-rear relationship, and is subjected to paper feed;

a first thermal head which prints on the first surface of the thermal paper sheet;

a second thermal head which prints on the second surface of the thermal paper sheet;

a first control section which divides printing data input from the outside into first printing data for the first thermal head and second printing data for the second thermal head; and a retrieval section which retrieves printing data corresponding to a previously registered keyword from the input printing data.

30. The thermal printer according to claim 29, wherein the first control section divides the input printing data into the first printing data including the retrieved printing data and the second printing data that does not include the retrieved printing data.

31. The thermal printer according to claim 29, wherein the keyword is at least one item included in primary printing data that should be printed on one surface of the thermal paper sheet.

32. The thermal printer according to claim 29, further comprising:

a registering section which registers the keyword.

33. The thermal printer according to claim 29, further comprising:

a detection unit which detects a position of the thermal paper sheet in the direction perpendicular to the paper feed direction of the thermal paper sheet; and a storage section which previously stores a width of the thermal paper sheet in the direction perpendicular to the paper feed direction of the thermal paper sheet.

34. A thermal printer, comprising:

a thermal paper sheet which has heat-sensitive layers on a first surface and a second surface having a front-and-rear relationship, and is subjected to paper feed;

a first thermal head which prints on the first surface of the thermal paper sheet;

a second thermal head which prints on the second surface of the thermal paper sheet; and a first control section which divides printing data input from the outside into first printing data for the first thermal head and second printing data for the second thermal head, wherein the respective thermal heads are provided in a state where they are perpendicular to the paper feed direction of the thermal paper sheet and each of the thermal heads has operation disabled regions each of which has a predetermined width on both ends thereof, and has an operation enabled region between both the operation disabled regions.

35. The thermal printer according to claim 34, wherein the variable control section has:

means for setting one end of the printing region of the first thermal head in accordance with a distance between one end of the operation enabled region of the first thermal head and one end of the thermal paper sheet in the direction perpendicular to the paper feed direction of the thermal paper sheet;

means for setting the other end of the printing region of the first thermal head in accordance with a width of the thermal paper sheet in the direction perpendicular to the paper feed direction of the thermal paper sheet;

means for setting one end of the printing region of the second thermal head in accordance with a distance between one end of the operation enabled region of the second thermal head and the other end or the one end of the thermal paper sheet in the direction perpendicular to the paper feed direction of the thermal paper sheet; and means for setting the other end of the printing region of the second thermal head in accordance with a width of the thermal paper sheet in the direction perpendicular to the paper feed direction of the thermal paper sheet.

* * * * *